US006460314B1

(12) United States Patent
Girard et al.

(10) Patent No.: US 6,460,314 B1
(45) Date of Patent: Oct. 8, 2002

(54) WRAPPING MACHINE FOR WRAPPING AN ARTICLE

(75) Inventors: Armand Girard; Jean-Yves Nadeau, both of Normandin (CA)

(73) Assignee: Gemofor Inc., Normandin (CA)

( * ) Notice: Subject to any disclaimer, the term of this patent is extended or adjusted under 35 U.S.C. 154(b) by 0 days.

(21) Appl. No.: 09/727,303

(22) Filed: Nov. 30, 2000

Related U.S. Application Data

(62) Division of application No. 09/354,072, filed on Jul. 15, 1999, now Pat. No. 6,279,295.

(30) Foreign Application Priority Data

Jul. 15, 1998 (CA) ..... 2240062

(51) Int. Cl.[7] ..... B65B 41/00

(52) U.S. Cl. ..... 53/389.3; 53/580; 53/66; 53/397; 53/416

(58) Field of Search ..... 53/397, 416, 485, 53/488, 491, 580, 66, 389.3

(56) References Cited

U.S. PATENT DOCUMENTS

| | | | | |
|---|---|---|---|---|
| 1,734,351 | A | * | 11/1929 | Sevigne et al. |
| 3,469,368 | A | * | 9/1969 | Churchill et al. |
| 3,808,767 | A | * | 5/1974 | Reid |
| 4,231,210 | A | * | 11/1980 | Nasode |
| 4,365,456 | A | * | 12/1982 | Ullman |
| 4,400,929 | A | * | 8/1983 | Iwaki et al. |
| 5,014,495 | A | * | 5/1991 | Bolejack et al. |
| 5,657,608 | A | | 8/1997 | Parvianinen et al. ..... 53/66 |
| 6,138,438 | A | * | 10/2000 | Michell et al. |

* cited by examiner

*Primary Examiner*—S. Thomas Hughes
*Assistant Examiner*—Eric Compton
(74) *Attorney, Agent, or Firm*—Ware, Fressola, Van Der Sluys & Adolphson LLP

(57) ABSTRACT

A wrapping machine is disclosed, for wrapping an article. The machine is designed for wrapping five surfaces of the article except the bottom thereof. The machine has detectors for determining the length of the front surface and the back surface of the article in order to provide a web piece having an adequate size for wrapping the article. The machine may have blowers for folding the web piece and providing a clean and net wrapped article. A method for wrapping an article is also provided.

12 Claims, 29 Drawing Sheets

50
8
143
133
134
233
234
334
335
317
7
6
107
108
116
117
146
118
114
115
135
136
319
137
326
207
208
227
228
219
239
221
222
131
132
231
232
309

WRAPPING MACHINE FOR WRAPPING AN ARTICLE

RELATED U.S. APPLICATION DATA

This application is a divisional of prior U.S. application Ser. No. 0/9/354,072, filed Jul. 15, 1999 now U.S. Pat. No. 6,279,295.

FIELD OF THE INVENTION

The present invention relates to a wrapping machine for wrapping five surfaces of an article except the bottom thereof, and a method to do the same. More particularly, the machine and the method of the present invention are useful for wrapping an article having a variable length such as a bundle of lumber, plywood or the like, or a pile of other products, or a single article.

BACKGROUND

A very significant proportion of lumber and construction panels are currently shipped and stored in bundles or piles wrapped in a waterproof envelope in order to provide a protection against alterations due to weather conditions and stabilise the humidity level.

Traditionally, the placement and folding of the wrapper sheet has mostly been carried-out in a semi-automatic fashion, a web like material being supplied from a material roll positioned above the article to be wrapped. Also, prefabricated plastic envelopes (bags) are currently used to speed-up the wrapping operation. The bag is generally installed from the top of the bundle, thus protecting the top and the sides of the bundle, while allowing some air circulation through the bottom. In this latter case, the envelope is manually secured to the bundle by stapling into the wood pieces. In this case, the operation is still quite expensive since extensive manpower is still required and the cost of the envelopes is relatively high.

Many automated solutions have been proposed in the prior art to wrap palletised articles In a plastic film or web. However, most of these solutions perform the wrapping operation by rotating a narrow plastic film roll around the load on a spiral path. Such techniques are not practical for elongate articles such as lumber bundles and do not provide automatic installation of a top web member nor yield a neat result.

It is also known in the art to use an automated system to slide a bundle of lumber into a bag that is then manually closed and sealed at one end. The economic performance of that process is still limited since expensive large prefabricated bags are required in a wide range of sizes, thus also resulting in inventory concerns.

Also known in the art, there is the U.S. Pat. No. 5,657,608 which discloses a fully automated method for wrapping a parallelepipedly shaped article such as a bundle of lumber, using a web like material supplied from a roll located over the article. The wrapper material is dispensed and folded around the article in a continuous process by the relative movements of a backing means and the article, plus the movement of the article with respect to spring loaded rollers as folding members. The principal embodiments of that invention as described show several limitations and drawbacks, The main drawback is certainly the fact that the process must be continuous, so that a new set-up is required after each time an incoming article does not require wrapping, that situation occurring frequently since only a part of lumber shipments must be wrapped. It shall also be noted that tho folding caused by the rollers is not precisely controlled and will generally yield a poor looking result and very visible folding lines on the long sides of the article. That poor looking result is also subject to be emphasised by the presence of static electricity in plastic based wrapper material. Moreover, it is worth indicating that it is generally not acceptable to apply adhesive all over the article to hold the web in place. Another obvious limitation of that process is that the article is moved back and forth a few times to complete the wrapping. Since the contemplated articles are long and heavy, a lot of time and energy is required.

SUMMARY OF THE INVENTION

The present invention is directed to a wrapping machine and a related method that overcome the above-mentioned drawbacks.

In accordance with the present invention, there is provided a wrapping machine for wrapping an article located in a wrapping area, comprising:

web delivering means for delivering a web;

first clamping means for clamping a first end of the web extending from the web delivering means;

first moving means for moving the first clamping means;

cutting means for cutting the web extending from the web delivering means and therefor providing a web piece for wrapping the article;

second clamping means for clamping a second end of the web piece that is a free end opposite to said first end;

second moving means for moving the second clamping means;

fastening means for fastening the web piece on the article; and a controller for controlling the web delivering means, the first and second clamping means, the first and second moving means, the cutting means, and the fastening means following a predetermined sequencing program in such a way that, in operation, the web piece is moved and put down over the article by means of the first and second clamping means and the first and second moving means, and is fastened to the article by means of the fastening means.

In accordance with the present invention, there is also provided a method for wrapping an article, comprising the steps of:

a) delivering a web by means of a web delivering means;

b) clamping a first end of the web extending from the web delivering means by means of a first clamping means;

c) moving said first end away from the delivering means by means of the first clamping means;

d) after stop (c), cutting the web extending from the web delivering means and therefor providing a web piece for wrapping the article;

e) clamping a second end of the web piece that is a free end opposite to said first end by means of a second clamping means;

f) moving and putting down the web piece over the article by means of the first and second clamping means; and g) after step (f), fastening the web piece on the article.

Advantageously, the machine and the method of the present invention provide an automatic adjustment of the length of the article.

According the method and the machine of the invention, it is not necessary to move the article during its wrapping which is very advantageous for heavy article.

The present invention has also the advantage of providing a fully automated machine with a very high level at control and accuracy.

A preferred embodiment of the invention has a further advantage of providing a clean and neat appearance of the wrapped article with the web folded only at the ends of the article and no apparent folding line.

The invention and its advantages will be better understood after reading the non restrictive description of a preferred embodiment of the present invention. This description is given with reference to the appended drawings.

DETAILED DESCRIPTION OF A PREFERRED EMBODIMENT OF THE INVENTION

Figure 1:
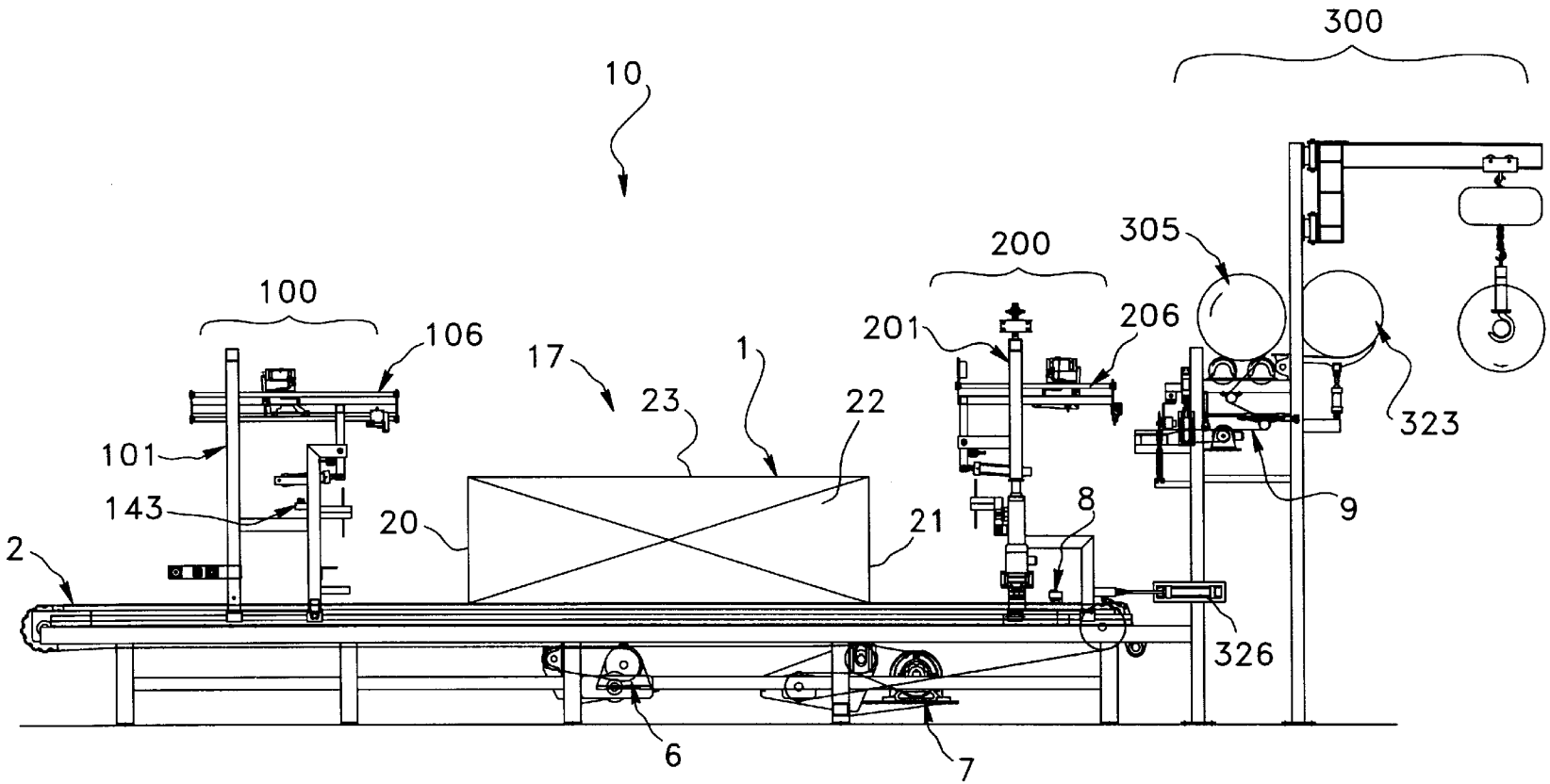
FIG. 1 a side view of a wrapping machine according to a preferred embodiment of the present invention, with the working environment.

Referring to FIGS. 1, 2, 27, 28 and 29, we will now generally describe a wrapping machine 10 for wrapping an article 1 located in a wrapping area 17. The wrapping machine 10 according to the present invention comprises web delivering means for delivering a web 9: first clamping means for clamping a first end 14 of the web 9 extending from the web delivering means; first moving means for moving the first clamping means; and cutting means for cutting the web 9 extending from the web delivering means and therefor providing a web piece 12 for wrapping the article 1. The machine 10 further comprises second clamping means for clamping a second end 15 of the web piece 12 that is a free end opposite to said first end 14; second moving means for moving the second clamping means; fastening means for fastening the piece 12 on the article 1; and a controller 50 illustrated in FIG. 26. The controller is for controlling the web delivering means, the first and second clamping means, the first and second moving means, the cutting means, and the fastening means following a predetermined sequencing program in such a way that, in operation, the web piece 12 is moved and put down over the article 1 by means of the first and second clamping means and the first and second moving means, and is fastened to the article 1 by means of the fastening means.

Figure 2:
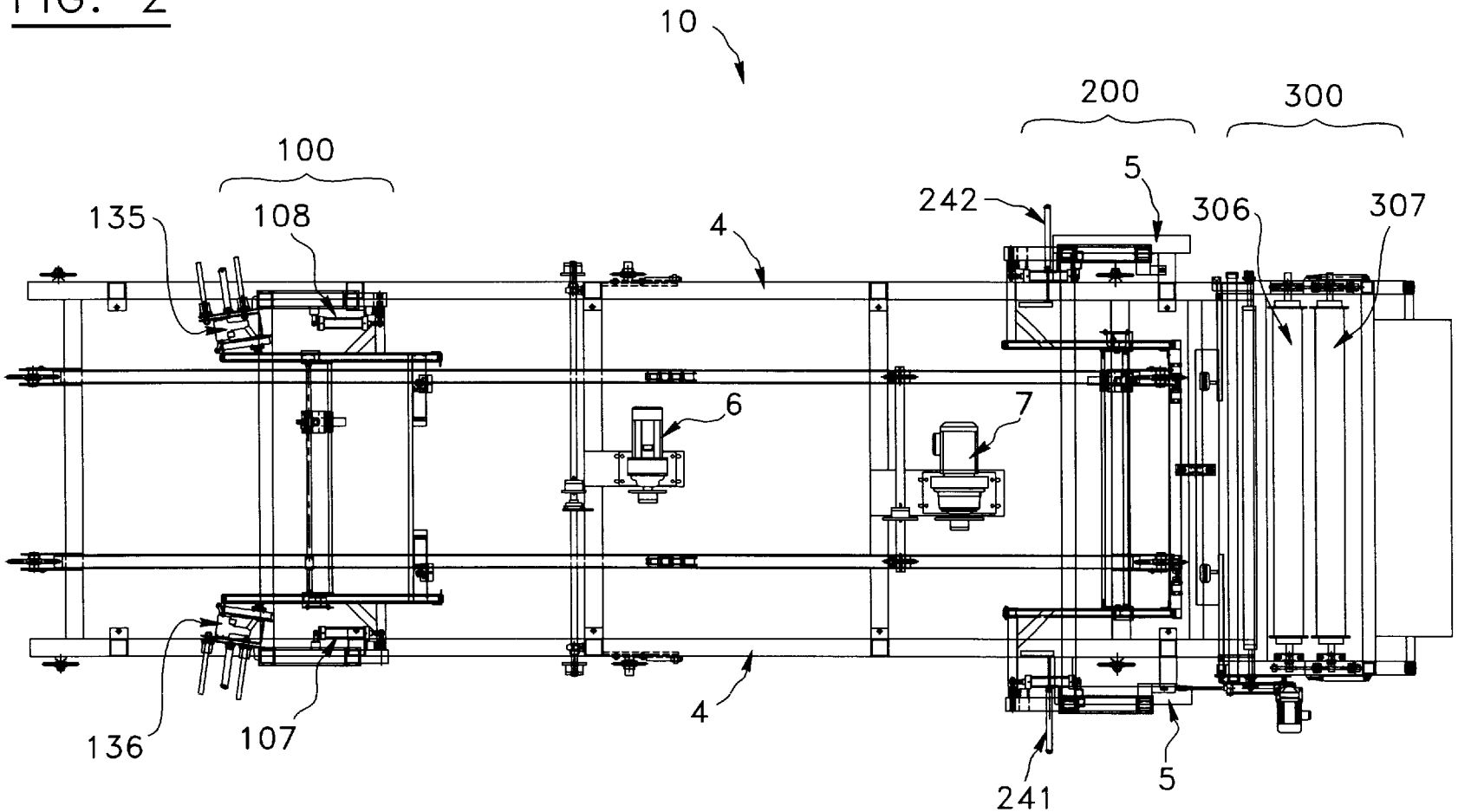
FIG. 2 is a top view of the wrapping machine shown in FIG. 1. which does not have the crane-and winch assembly.
Figure 3:
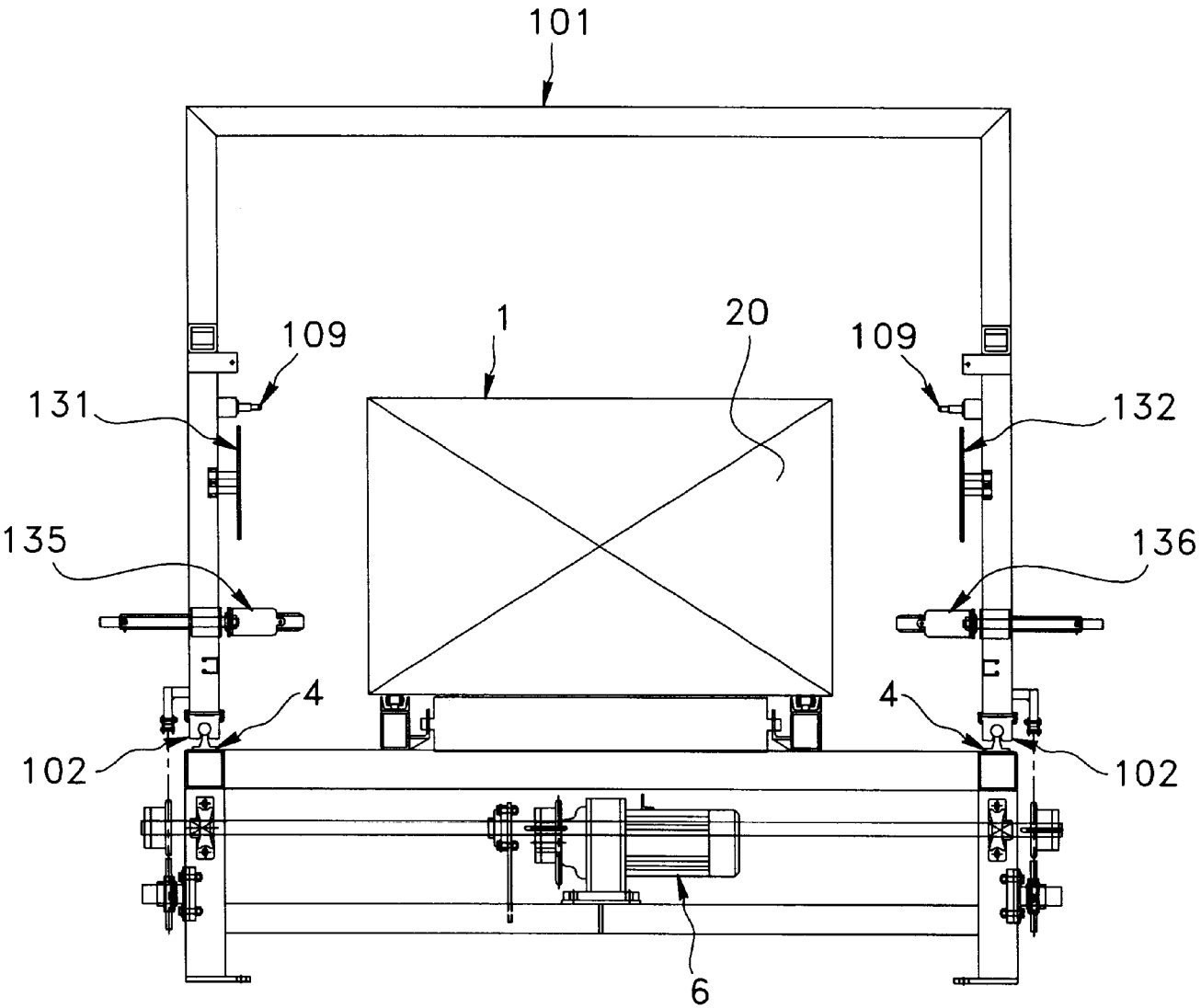
FIG. 3 is a front view of the first assembly of the machine shown in FIG. 1, where the first pivoting frame is missing for sake of clarity.
Figure 29:
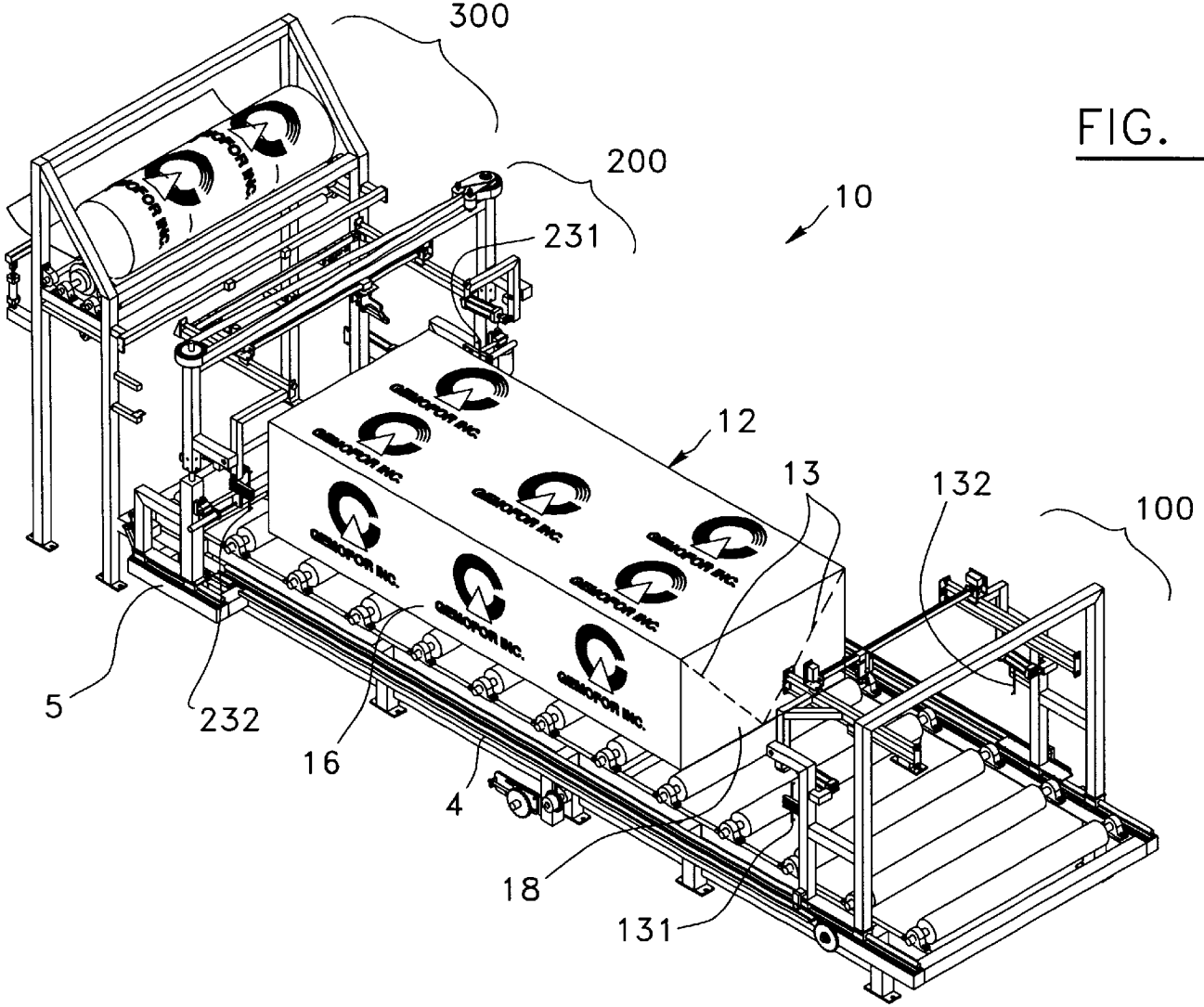
FIG. 29 is a perspective view of a wrapping machine according to a preferred embodiment of the present invention, showing the article completely wrapped by the web piece and the working environment.

We will now describe throe assemblies of tho machine 10 that are structurally in relation with the above mentioned means and indicated in FIGS. 1, 2 and 29.

More particularly, the first moving means comprise a first assembly 100 on which the first clamping means is mounted, and a first sliding means for sliding the first assembly 100 along the wrapping area 17. The first sliding means are controlled by the controller 50 illustrated in FIG. 26. The second moving means comprise a second assembly 200 on which the second clamping means is mounted, and a second sliding means for sliding the second assembly 200. The second sliding means being controlled by the controller 50. The machine further comprises a third assembly 300 on which the web delivering means and the cutting means are mounted.

Referring to FIGS. 1, 2, 3 and 29, the first sliding means for sliding the first assembly 100 comprise a pair of rails 4 parallel to opposite sides of the wrapping area 17, and sliding members 102 mounted under the first assembly 100 and for slidably engaging the rails 4. The sliding motion of the first assembly 100 on the rails 4 is driven by the motor 6.

Referring to FIGS. 1, 2, 6 and 29, the second sliding means for sliding the second assembly 200 comprise a pair of rails 5 parallel to opposite sides of the wrapping area 17, and sliding members 202 mounted under the second assembly 200 for slidably engaging the rails 5. The sliding motion of the second assembly 200 on the rails 5 is driven by the powered cylinder 326 indicated in FIG. 1.

Figure 28:
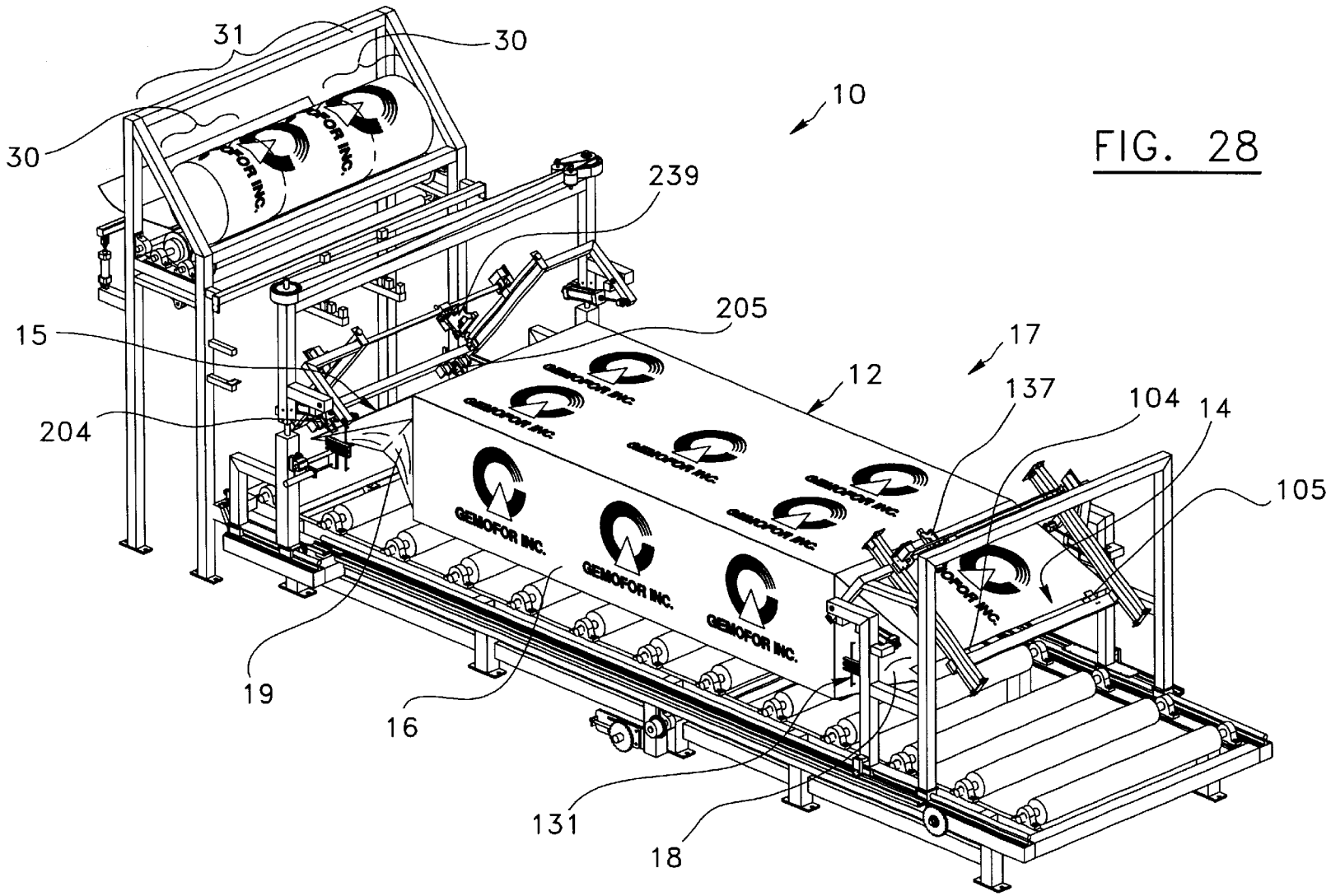
FIG. 28 is a perspective view of a wrapping machine according to a preferred embodiment of the present invention, showing the article partially wrapped by the web piece and the working environment.

We will now describe staplers which are among many tools that could be used to fasten the web piece 12 to the article 1 shown in FIG. 28 and 29. It should be noted that the wrapping machine 10 of the invention has been designed for wrapping a pile of lumbers and, consequently it is not a problem to staple a web to the pile of lumbers. However, the machine 10 of the invention is very useful to wrap many other type of article on which it may not be suitable to staple. In this case, other fastening means may be used such as adhesive material, fusion processing with heat stem, thermosealing, or the like.

Referring to FIGS. 1, 4, 5 and 28 and 29, the fastening means comprise a front stapler 137 mounted on the first assembly 100 for stapling the web piece 12 to a front surface 20 of the article 1, and a third moving means for moving the front stapler 137 along the front surface 20 of the article 1. The third moving means are mounted on the first assembly 100, and comprise a first powered cylinder 118 for moving horizontally the front stapler 137, and two second powered cylinders 114 et 115 for moving the same vertically and being perpendicular to the first powered cylinder 118. The third moving means further comprise front stapler detecting means for detecting a position of the front stapler 137 along each of said cylinders. The front stapler detecting means comprises one detector 133 shown in FIG. 4, for detecting the position of the front stapler 137 along the cylinder 118, and another detector 134 for detecting the position of the front stapler 137 along the cylinders 114 and 115. Both detectors 133 and 134 provide an output signal to the controller 50 illustrated in FIG. 26.

Referring to FIGS. 1, 7, 8, 28 and 29, the fastening means further comprise a rear stapler 239 mounted on the second assembly 200 for stapling the web piece 12 to a back surface 21 of the article 1, and a fourth moving means for moving the rear stapler 239 along the back surface 21 of the article 1. The fourth moving means are mounted on the second assembly 200, and comprise a first powered cylinder 219 shown in FIG. 7, for moving horizontally the rear stapler 239, and two second powered cylinders 221 and 222 shown in FIG. 8, for moving the some vertically and being perpendicular to the first powered cylinder 219. The fourth moving means further comprise rear stapler detecting means for detecting a position of the roar stapler 239 along each of said cylinders. The rear stapler detecting means comprise one detector 234 shown in FIG. 7, for detecting the position of the rear stapler 239 along the cylinder 219, and another detector 233 for detecting the position of the rear stapler 239 along the cylinders 221 and 222. Each detector and powered cylinder mentioned above and hereinafter are preferably a linear encoder and a pneumatic rodless linear cylinder with magnetic piston. Both detectors 233 and 234 provide an output signal to the controller 50 illustrated in FIG. 26.

Referring to FIGS. 1, 3, 28 and 29, the fastening means further comprise two side staplers 135 and 136 mounted respectively on opposite sides of the first assembly 100 for fastening side portions 16 of the web piece 12 to side surfaces 22 of the article 1.

Figure 26:
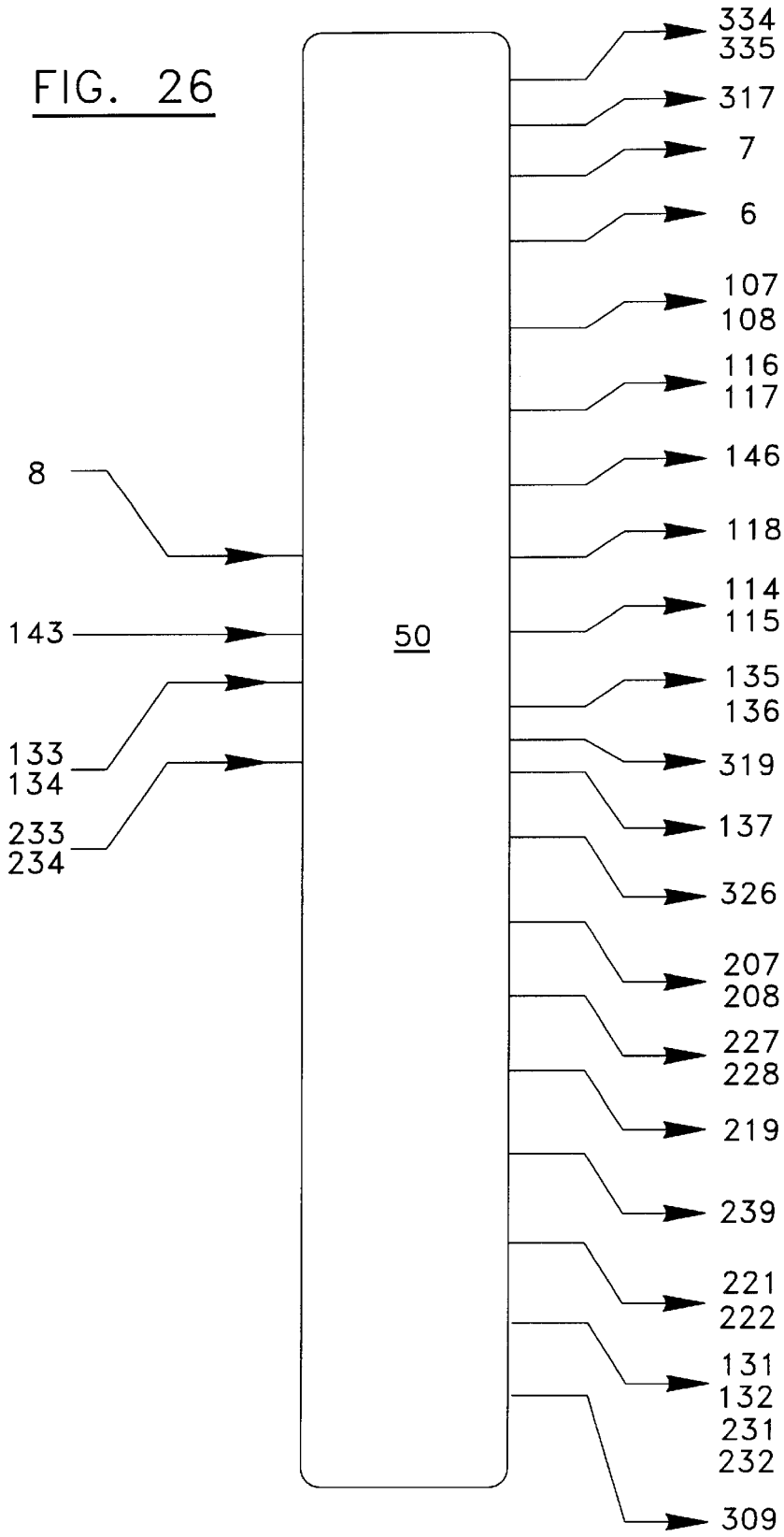
FIG. 26 is a diagram of the controller.

Referring again to FIG. 1, we will now describe article detectors of the machine 10 further comprises a conveyor 2 controlled by the controller 50 for conveying the article 1 within a wrapping area 17, and first detecting means 8 mounted on the second assembly 200, for detecting a back surface 21 of the article 1 and providing an output signal to the controller 50 illustrated in FIG. 26. The controller 50, in operation, controls the conveyor 2 to align the back surface 21 of the article 1 with a proper location in the wrapping area 17. The machine further comprises second detecting means 143 mounted in the first assembly 100, for detecting a front surface 20 of the article 1 and providing an output signal to the controller 50 which, in operation, controls the first moving means to move the first clamping means away from the web delivering means at a specific distance which is in relation with the length of the article 1 so that the cutting means is in a proper position to cut a web piece 12 having a size adapted to cover a top surface 23, a front surface 20, a back surface 21 and two opposite side surfaces 22 of the article 1.

The article 1 may slide on the conveyor 2. Consequently, It is planned that the machine 10 can comprise an alignment system for aligning the article with the conveyor 2 before conveying it in the wrapping area 17.

Since the machine 10 is designed for wrapping a bundle of lumbers among others and such bundle may has an end of wood extending out, it planned that the machine 10 can comprises a trimming system for cutting such end of wood. A end of wood extending out the article 1 could interfere with the wrapping processing.

We will now describe different elements mounted on the third assembly 300. Referring now to FIGS. 1, 2, 9 to 12, the web delivering means has a roll support composed of two cradle rollers 306 and 307, for supporting a roll of web 305 from which the web 9 is delivered.

Figure 27:
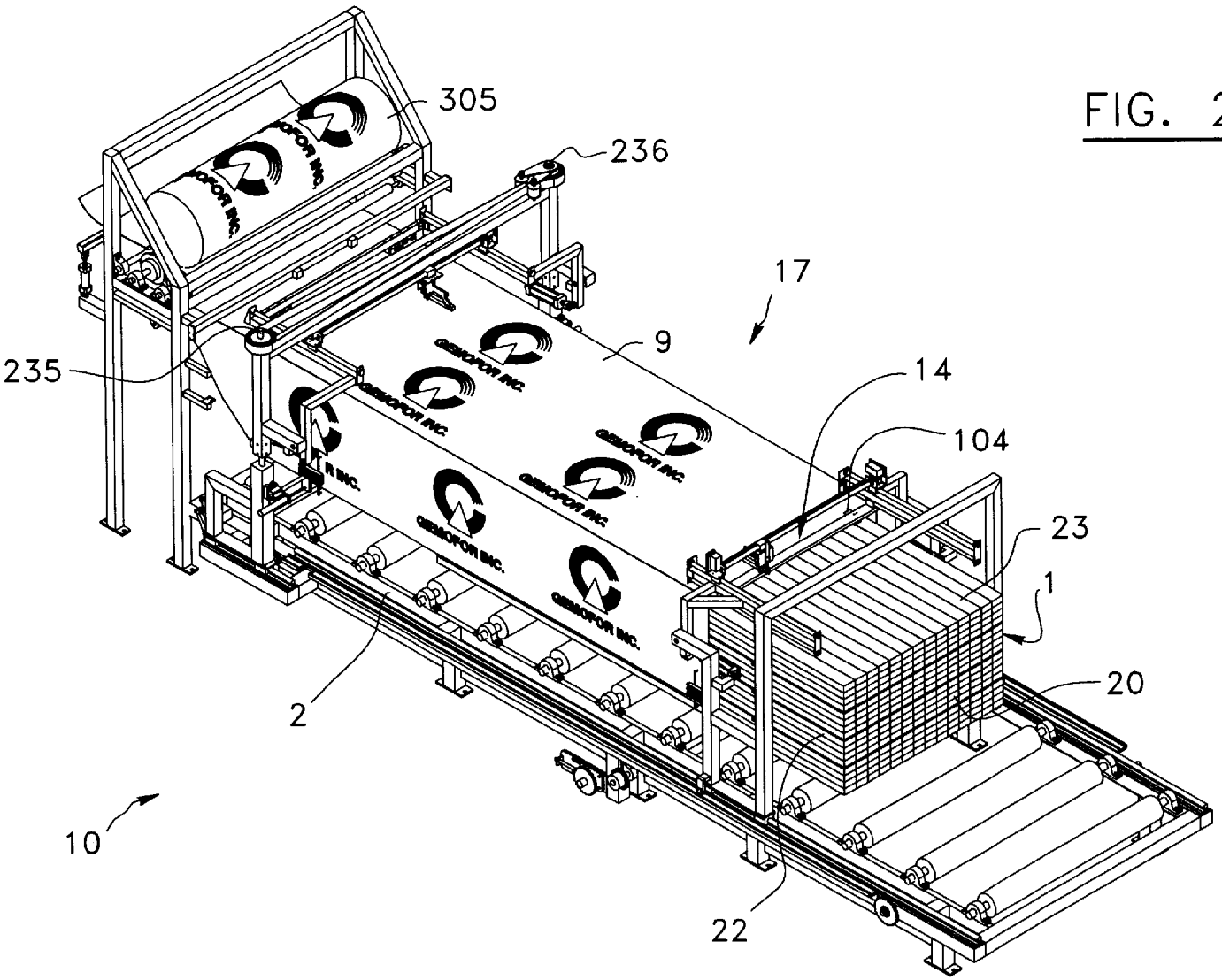
FIG. 27 is a perspective view of a wrapping machine according to a preferred embodiment of the present invention, showing the article partially covered by the web and the working environment.

Referring more particularly to FIGS. 27 and 28 and according to the preferred embodiment of the invention, the web 9 in the roll 305 has two opposite side portions 30 fold under a central portion 31 thereof, where the central portion has a width determining the width of the roll 305 which is slightly superior to the width of the top surface 23 of the article 1. The fold side portions 30 of the web 9 fold under the central portion 31 of the web 9 are indicated on the roll 305 in FIG. 28 with dotted lines. It should be understood that the web 9 can be in a roll without being fold as explained above. In such a case, the roll of web would be as long as the width of the web and adapters could be provided for avoiding interference between the web from the roll and the second assembly 200. It should be understood also that it is not necessary that the web is delivered from a roll, since the web could be fold up in a pile or in any other form.

Figure 9:
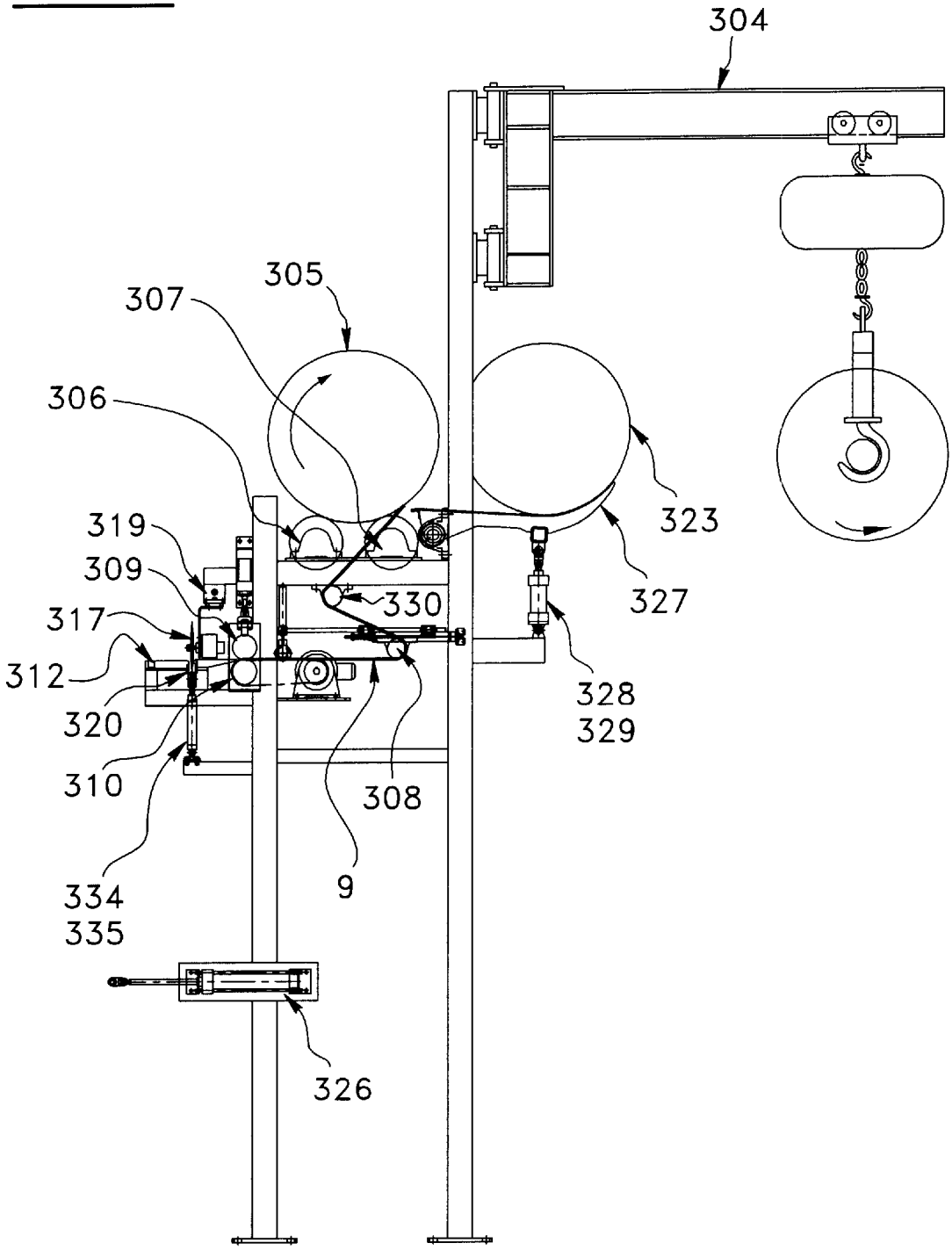
FIG. 9 is a side view of the third assembly of the machine shown in FIG. 1.

Referring to FIGS. 1 and 9, the machine preferably further comprises an over head crane-and-winch assembly 304 for supplying a spare roll of web 323 to a base 327. It is to be understood that other lifting apparatus can be used in replacement of the crane-and-winch assembly 304 such as an elevator. The base 327 is pivotally mounted on the third assembly 300 and can be raise up by means of the powered cylinders 320 and 329 for pushing the spare roll of web 323 on the cradle rollers 306 and 307.

Figure 21:
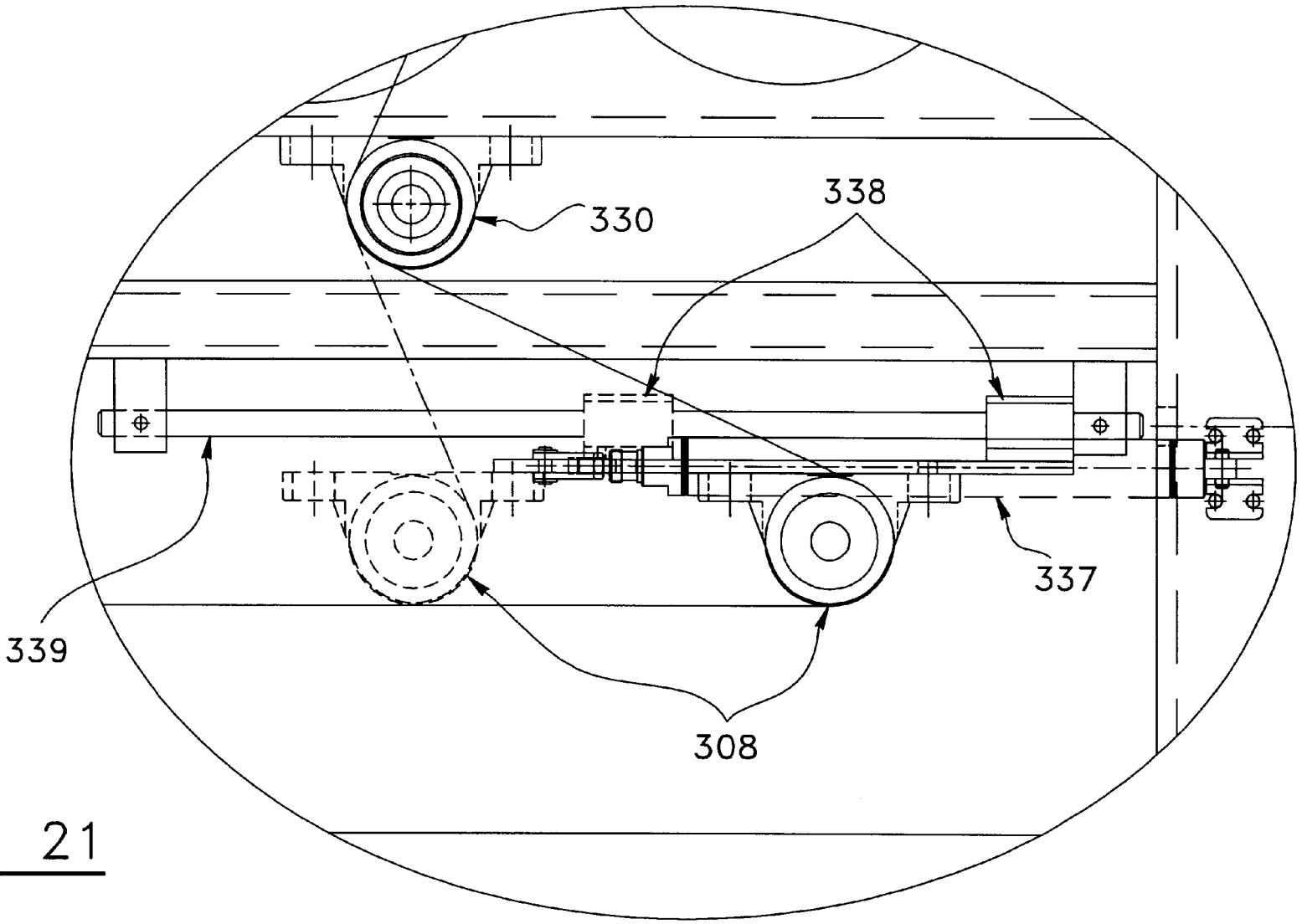
FIG. 21 is a side view of a portion of the third assembly shown in FIG. 9, where a tension relief roller is in a back position and in a front position.

Referring more particularly to FIGS. 9 and 21, the web delivering means comprises advantageously a tension relief roller 308 to make sure that the web 9 is delivered equally from side-to-side of the roll 306. The tension relief roller 308 has a sliding bushing 338 on each extremity thereof, which is slidably engaged on a guiding shaft 339 and is driven by the powered cylinder 337.

Figure 12:
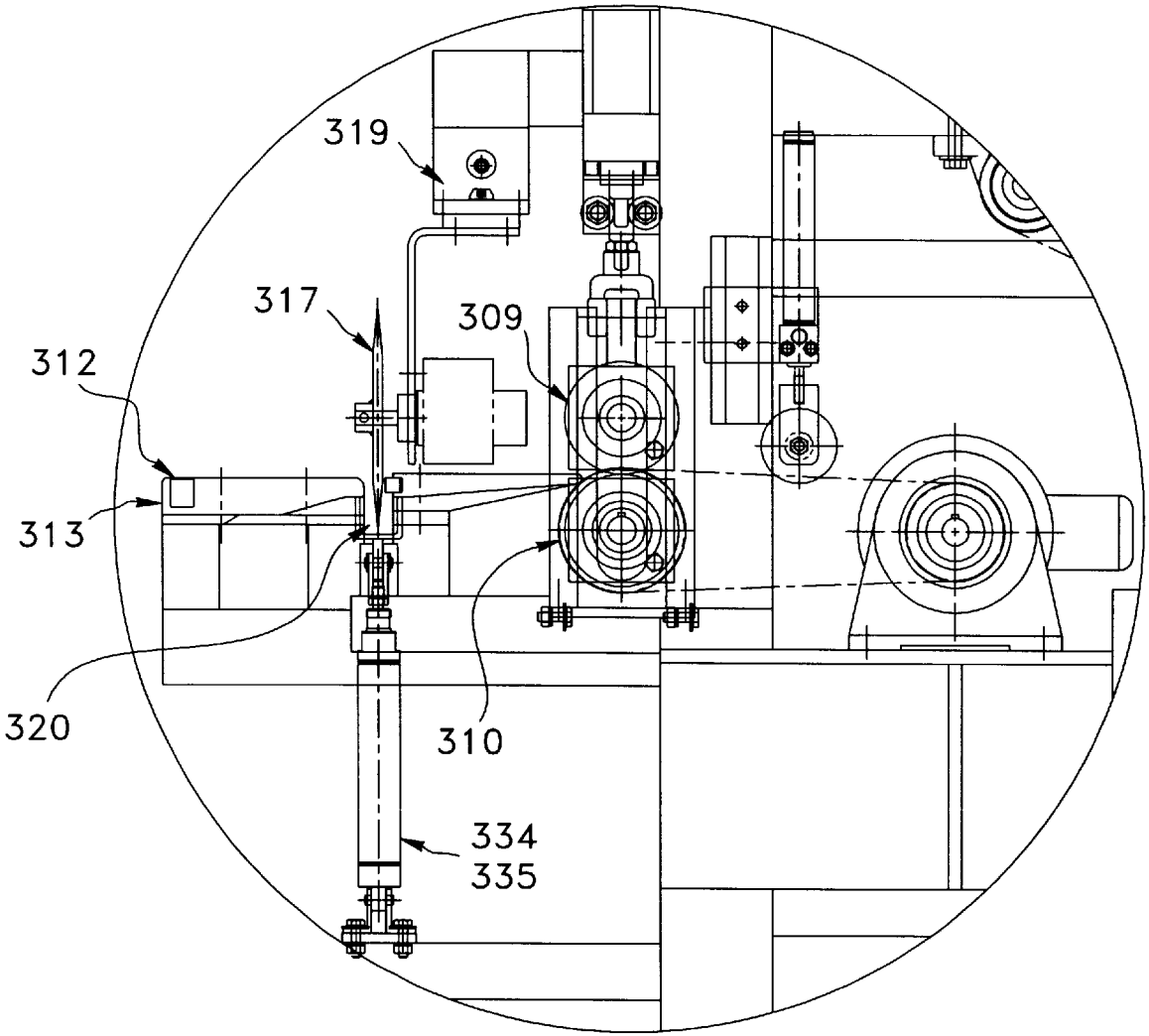
FIG. 12 is a side view of a portion of the web delivering means shown in FIGS. 10 and 11.

Referring now to FIGS. 9 and 12, the web delivering means further comprise a motorised upper drive roller 309 and a lower roller 310 for squeezing the web 9 extending from the roll 30*b* between them and pulling out the web 9 from the roll 309 by the motion of the motorised upper drive roller 309. The web delivering means also comprise a shelf 313 for separating the central portion 31 of the told web 9 from the side portions thereof. Such separation is particularly useful for allowing the first and second clamping means to clamp only locations on the central portion 31 of the web 9.

Referring to FIGS. 10, 12, 19, 20 and 28, the cutting means is preferably a circular rotary blade 317, and the shelf 313 of the web delivering means has a slot 320 for allowing the rotary blade 317 to go through. Since the central portion 31 of the web 9 slides above the shelf 313 and the rotary blade 317 engages the slot 320, the central portion 31 is cut all way long when the rotary blade 317 is moved from side-to-side of the shelf 313. The rotary blade 317 is driven laterally along the powered cylinder 319 shown in FIG. 10, 11 and 12.

Figure 10:
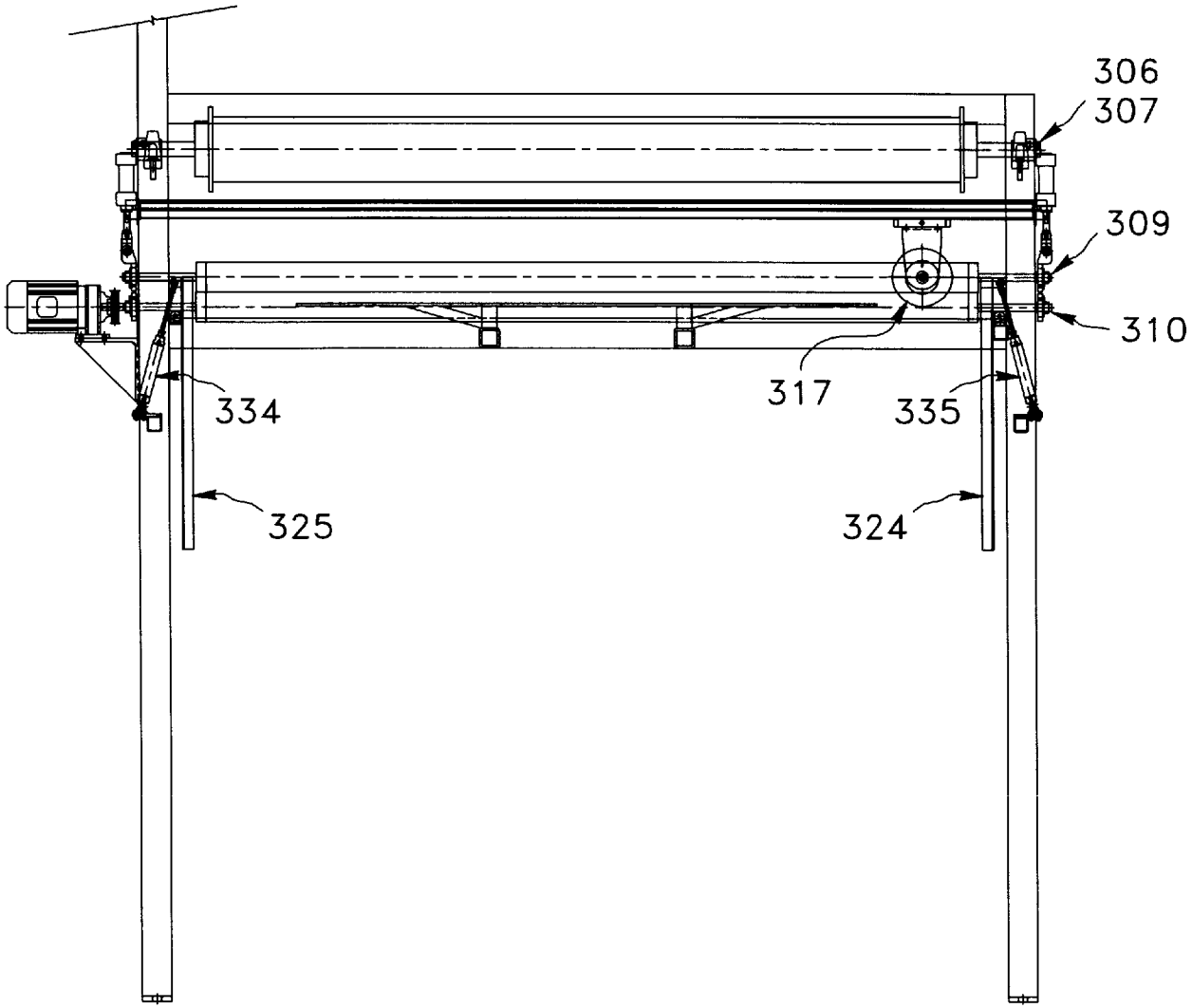
FIG. 10 is a rear view of the web delivering means, the cutting means and a portion of the third assembly shown in FIG. 9.
Figure 11:
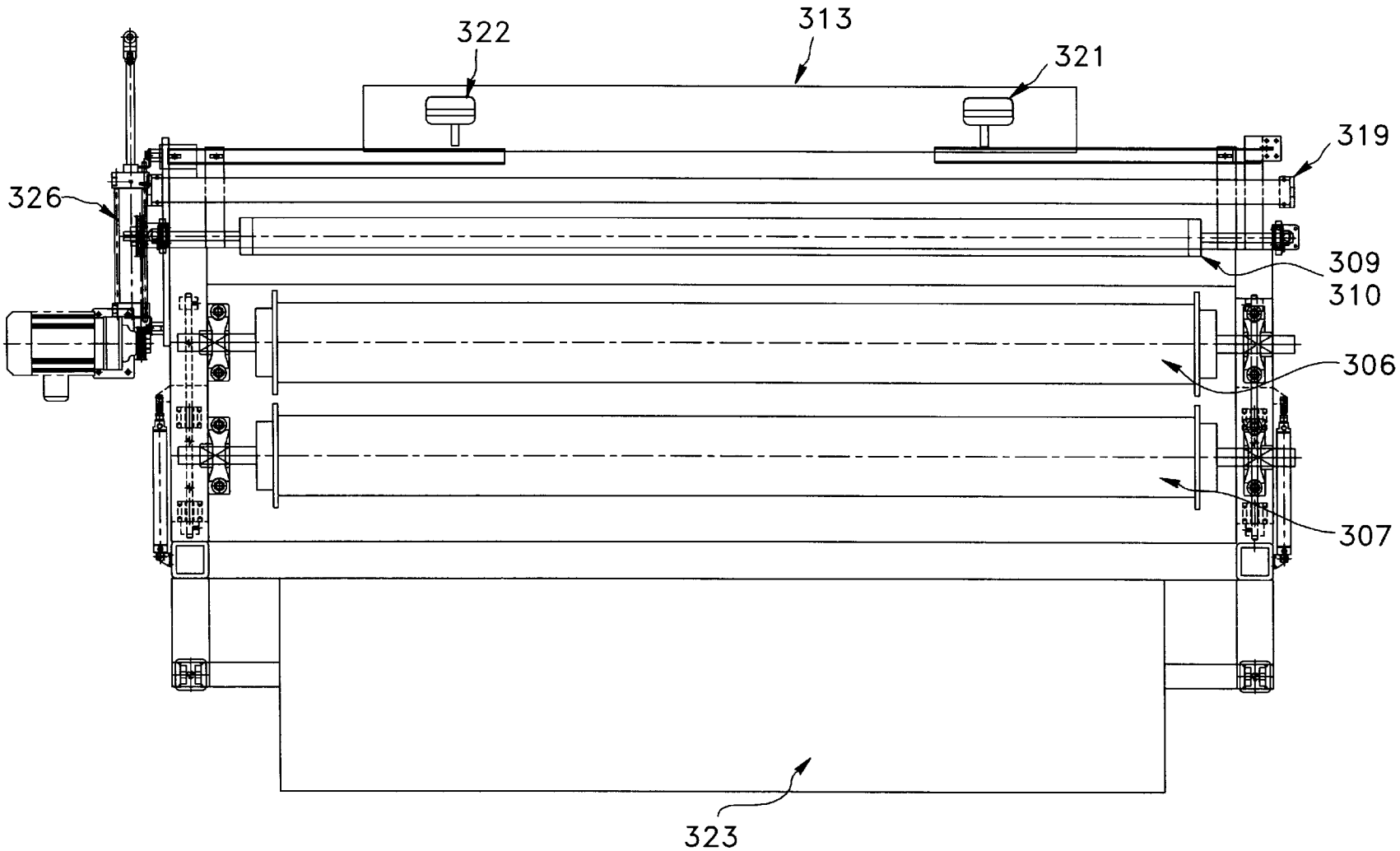
FIG. 11 is a top view of the web delivering means shown in FIG. 10.
Figure 19:
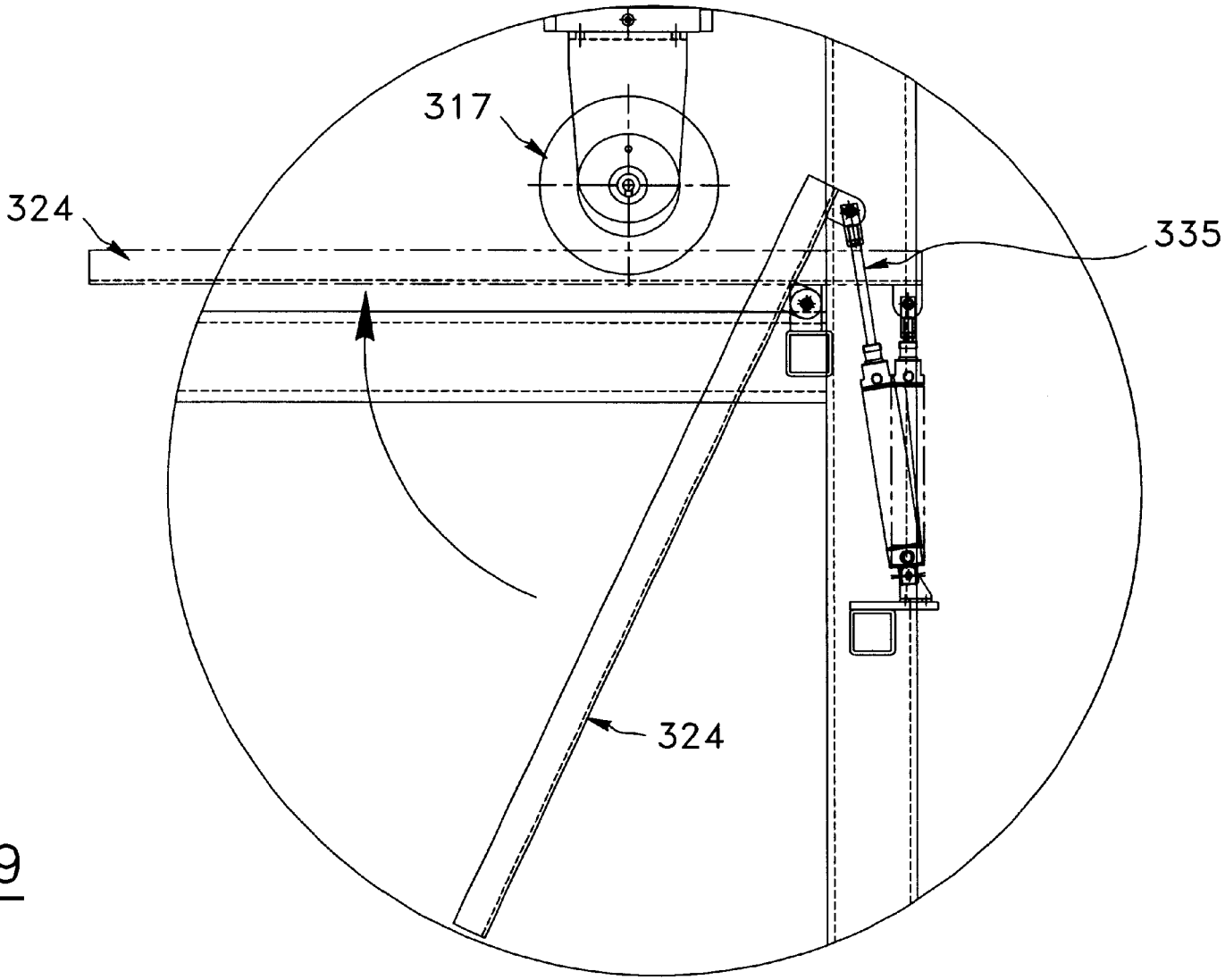
FIG. 19 is a front view of a portion of the third assembly shown in FIGS. 9 and 10, showing a portion the retractable supporting means.

To make sure that the side portions 30 of the web 9, shown in FIG. 28, is cut at the same time then the central portion thereof, file third assembly 300 is provided with retractable supports 324 and 325 and powered cylinders 334 and 335 for driving them as illustrated in FIGS. 10 and 19. The retractable support 324 and 325 have an upper concave surface 340 which is align with the path of the rotary blade 317 so that, when the retractable supports 324 and 325 are raised up against the shelf 313, the blade 317 engages the concave surface 340 and cut the side portions 30 of the web 9 slid between the shelf 313 and the retractable supports 324 and 325.

Figure 4:
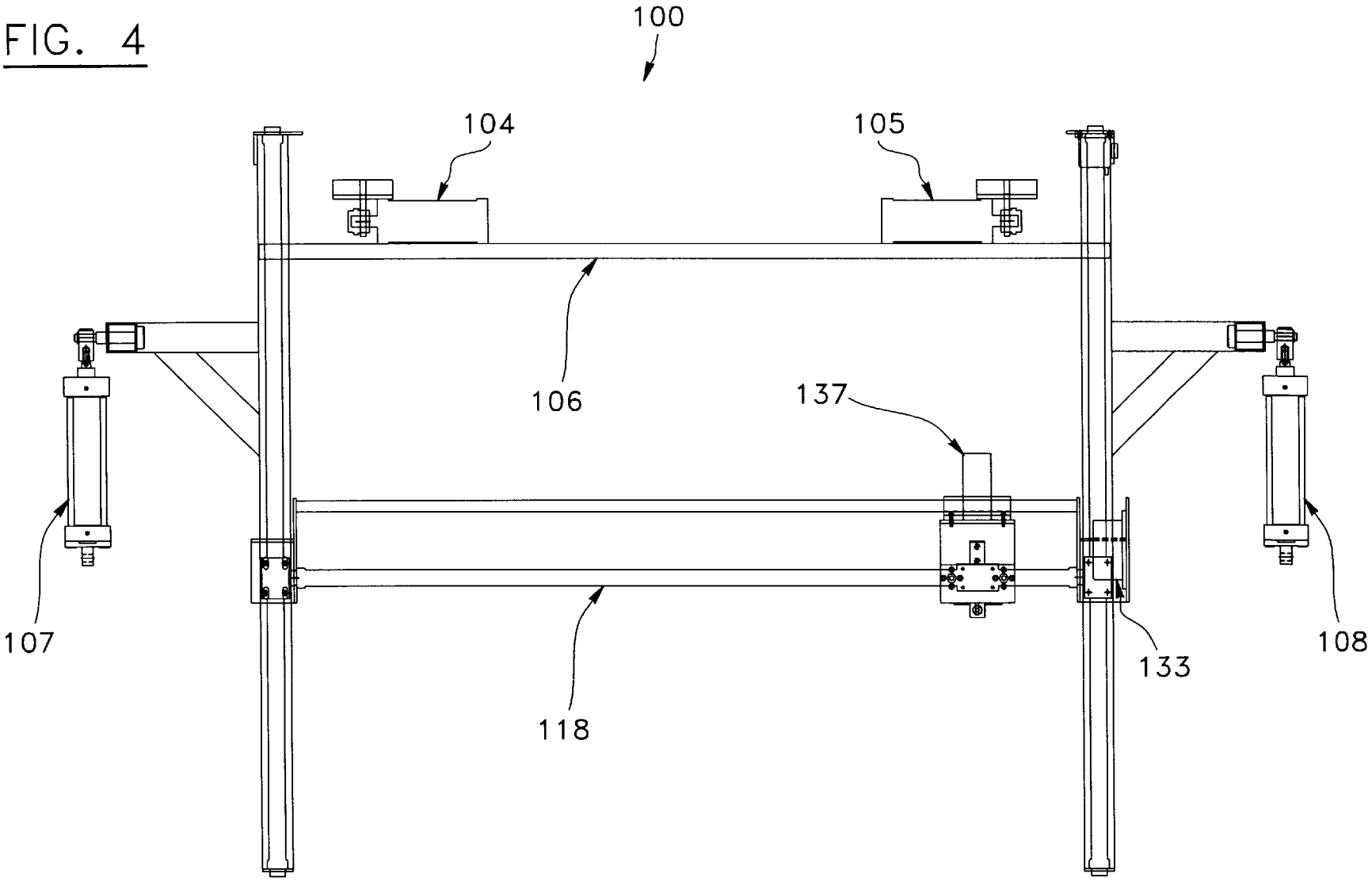
FIG. 4 is a front view of the first pivoting frame of the first assembly of the machine shown in FIG. 1.

We will now describe clamps of the machine 10. Referring now to FIGS. 4, 21 and 28, the first clamping means comprise a pair of clamps 104 and 105 for clamping two points on the first end 14 of the web 9 that are spaced apart by a distance corresponding to a width of the top surface 23 of the article 1 and centrally located along the first end 14 of the web 9.

Figure 7:
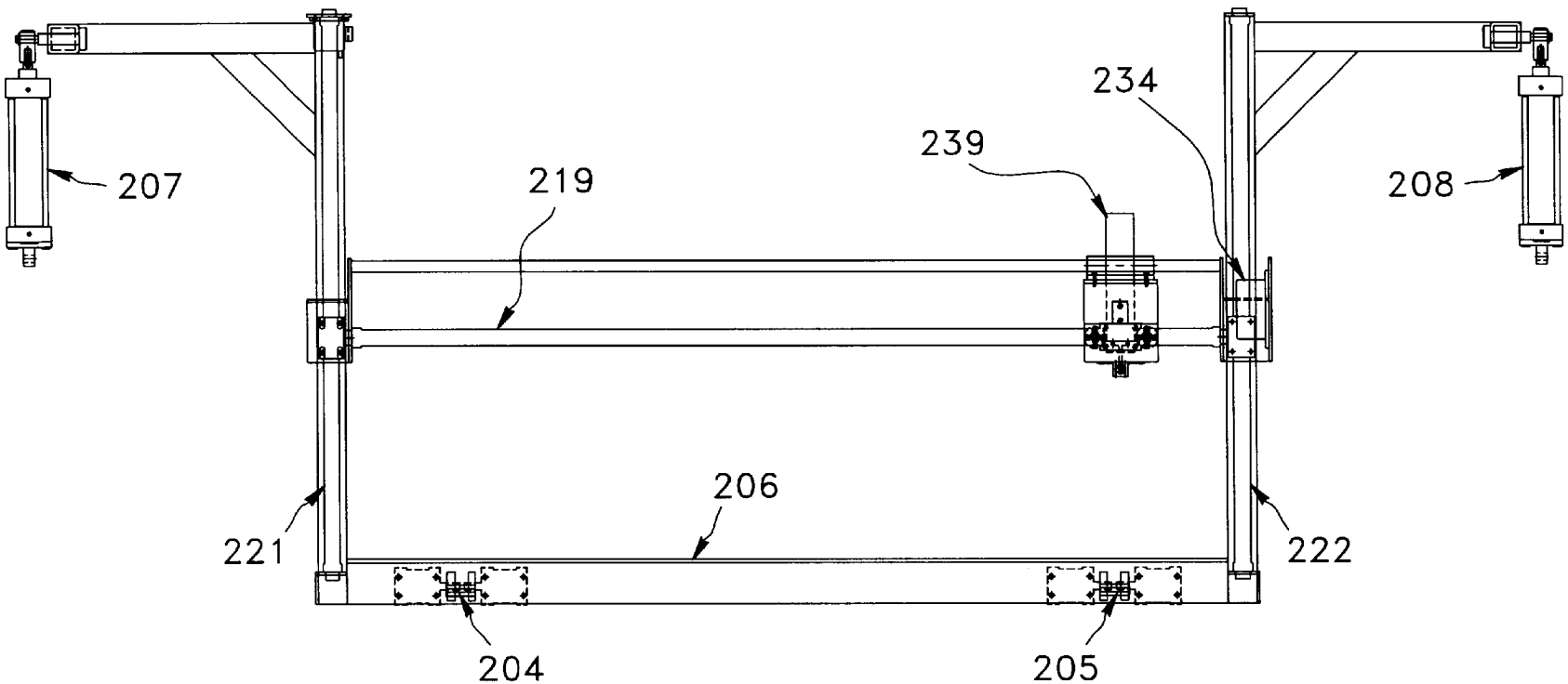
FIG. 7 is a front view of the second pivoting frame of the second assembly of the machine shown in FIG. 1.
Figure 8:
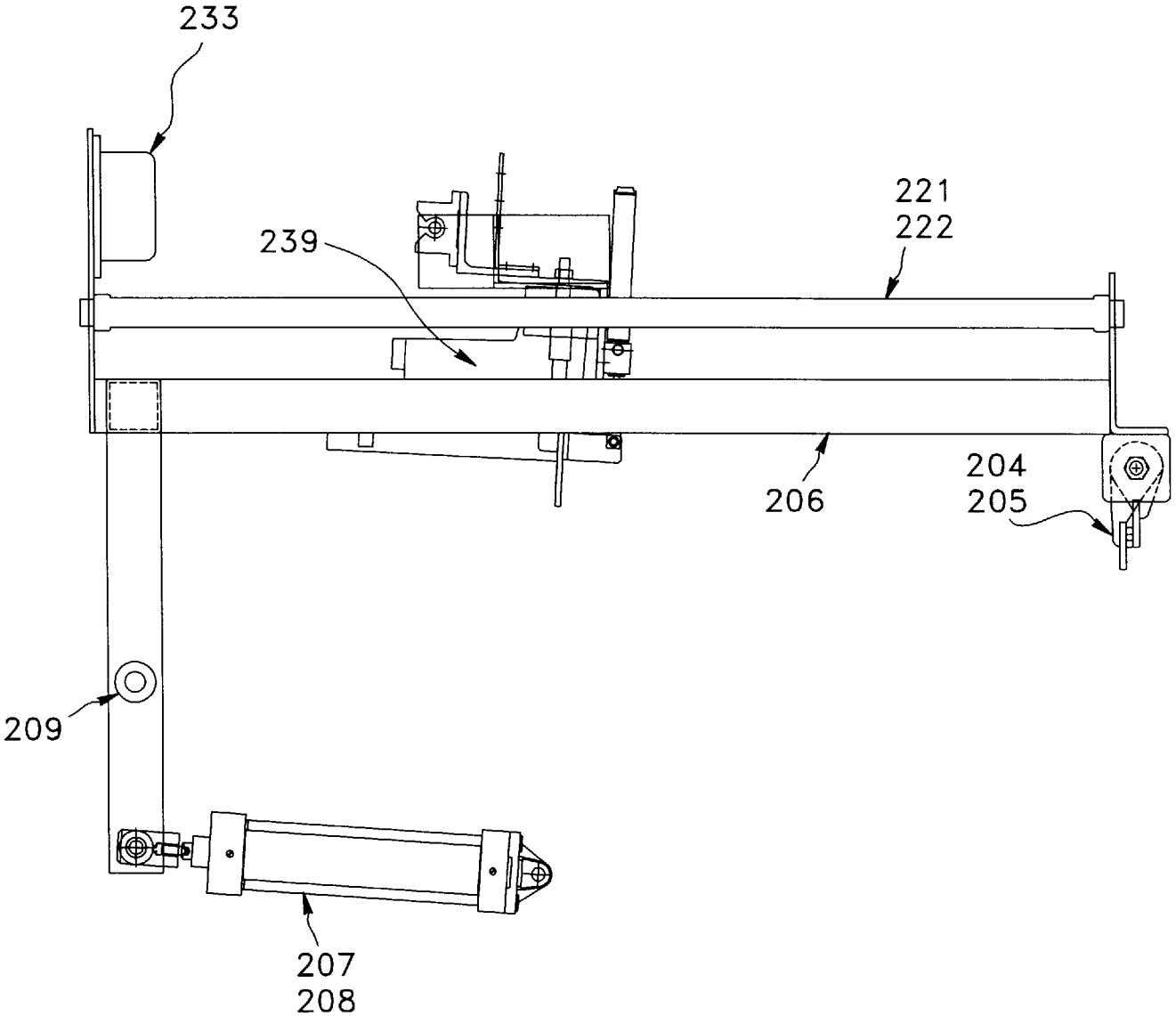
FIG. 8 is a side view of the second pivoting frame shown in FIG. 7.

Referring to FIG. 7, 27 and 28, the second clamping means comprise a pair of clamps 204 and 205 for clamping two points on the second end 15 of the web piece 12 that are spaced apart by a distance corresponding to the width of the top surface 29, of the article 1 and centrally located along the second end 15.

Figure 24:
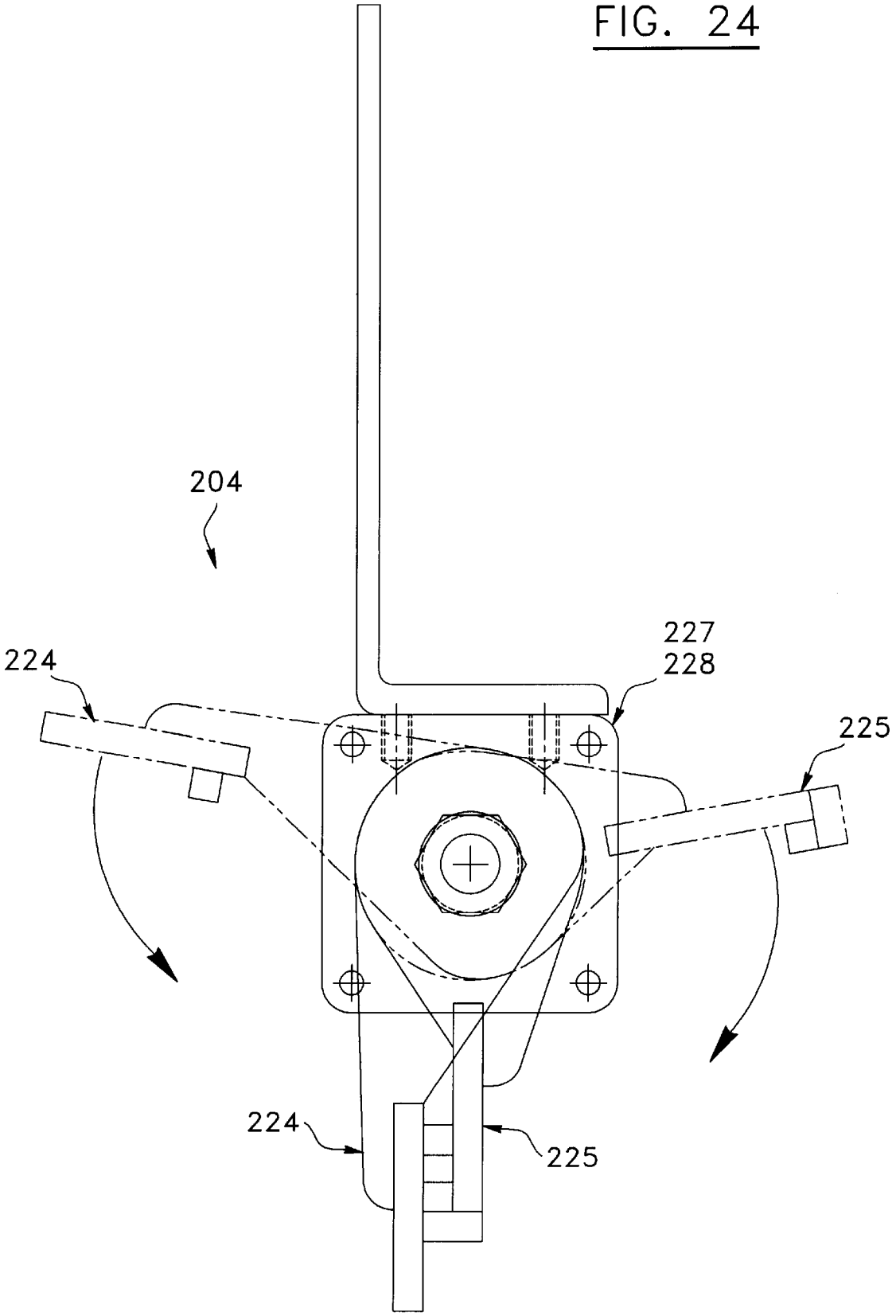
FIG. 24 is side view of a clamp of the second clamping means shown in FIG. 13, where two jaws of the clamp are in open position and in closed position.
Figure 25:
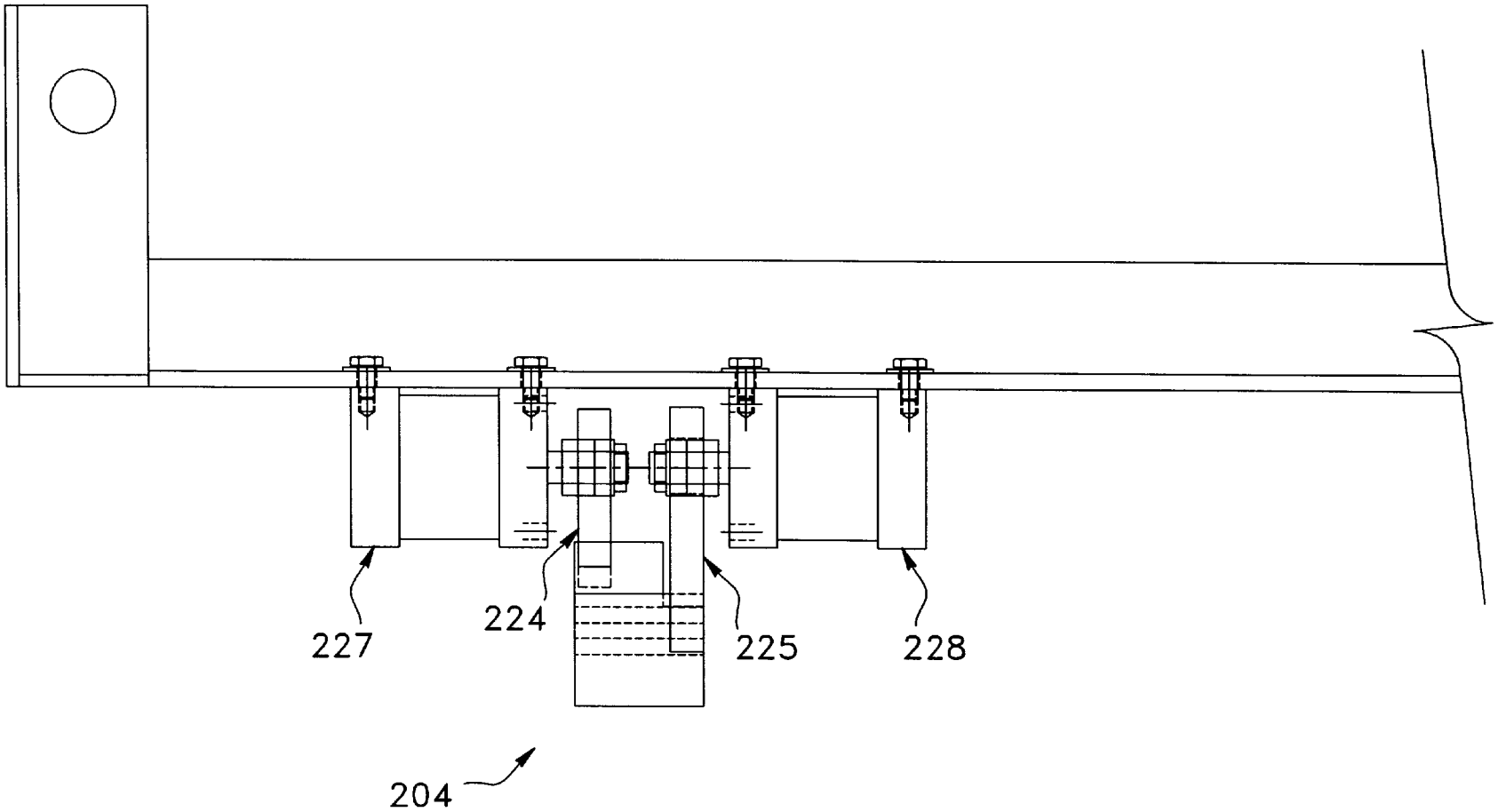
FIG. 25 is a top view of the clamp of FIG. 24.

Referring now to FIGS. 24 and 25, the second moving means also comprise third pivoting means for pivoting the clamps 204 and 205 around an horizontal axis parallel to the back surface 21 of the article 1 shown in FIG. 1. FIGS. 24 and 25 show only clamp 204 since clamps 204 and 205 are preferably identical. More particularly. the third pivoting means comprise a powered rotary cylinder for each jaw of each clamp 204 and 205. Each clamp 204, 205 has a longer jaw 224 and a shorter jaw 225 which are driven respectively by the powered rotary cylinder 227 and 228.

Figure 22:
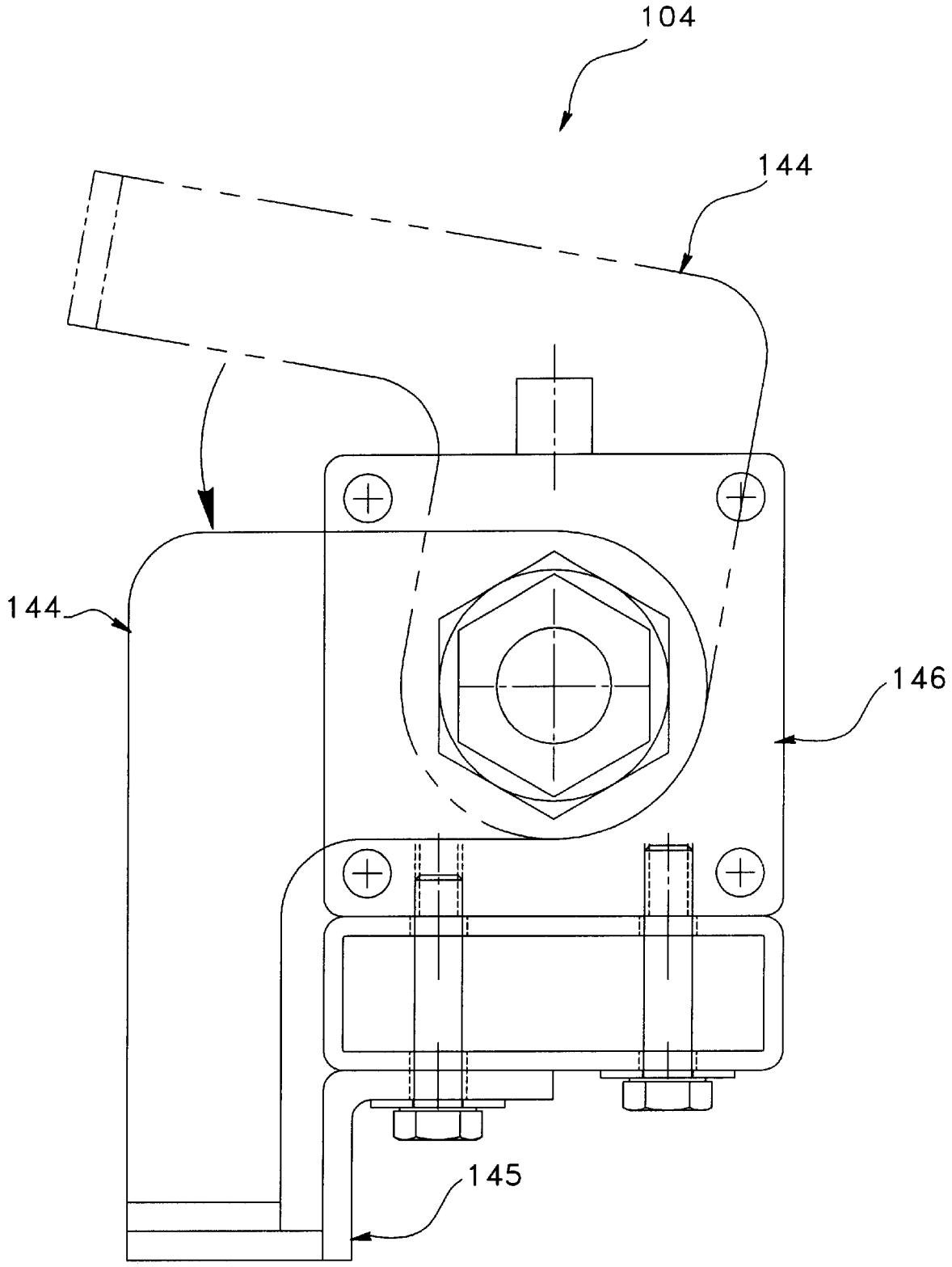
FIG. 22 is a side view of a clamp of the first clamping means shown in FIGS. 16, 17 and 18, where a jaw of the clamp in is an open position and a closed position.
Figure 23:
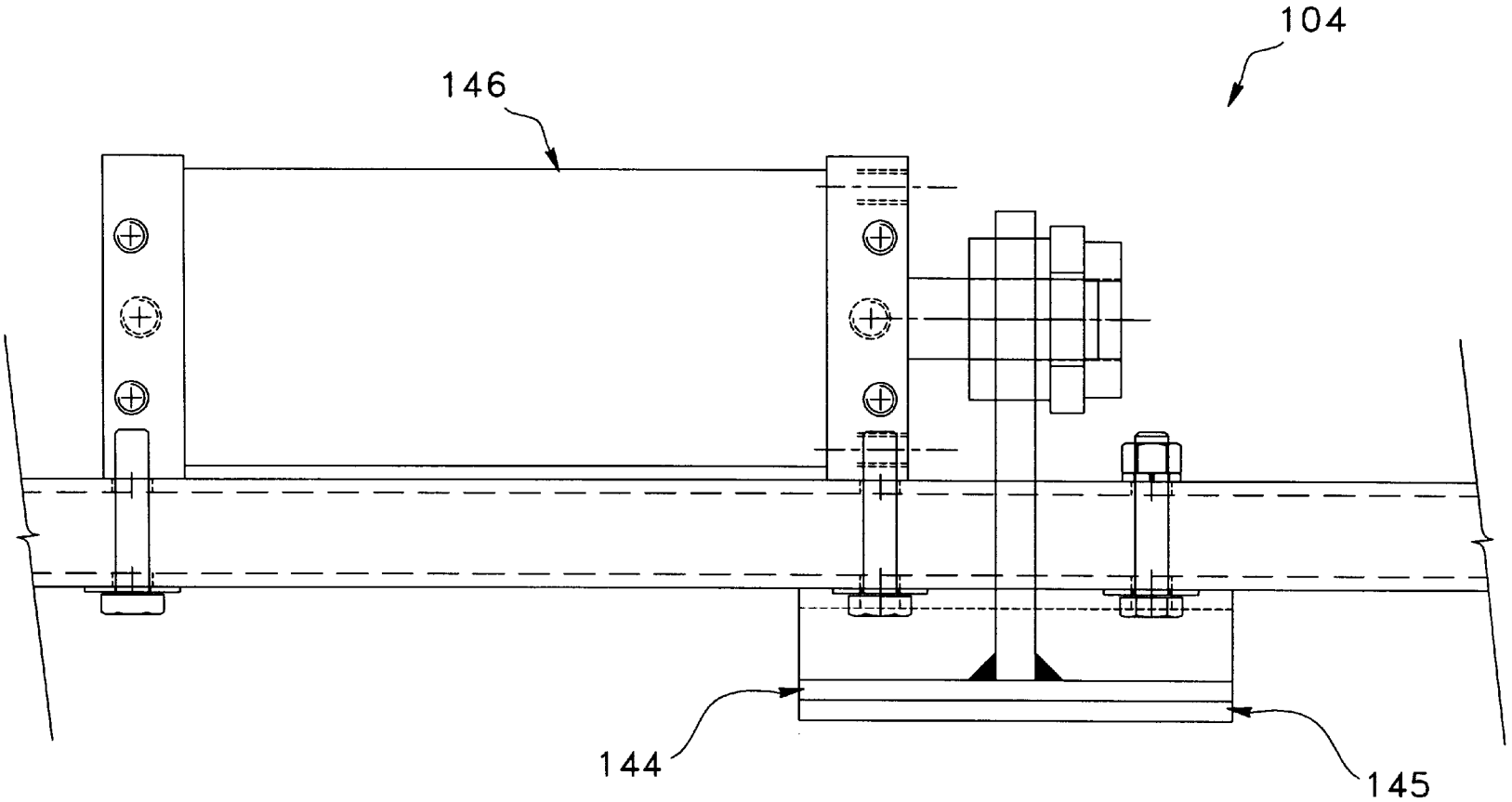
FIG. 23 is a top view of the clamp shown in FIG. 22.

FIGS. 22 and 23 show only clamp 104 since clamps 104 and 105 are preferably identical. Each of clamps 104, 105 has a fixed jaw 145, a pivoting law 144 and 8 powered rotary cylinder 146 for driving the pivoting jaw 144.

We will now describe different elements mounted on the first assembly 100. Referring more particularly to FIGS. 1, 16, 17 and 18, the first moving means comprise preferably a first pivoting frame 106 pivotally mounted on the main frame 101 of the first assembly 100, and first pivoting means for pivoting the first pivoting frame 106 between an horizontal position (shown in FIG. 16) higher than the height of the front surface 20 of the article 1 and a vertical position (shown in FIG. 18) parallel to the front surface 20 of the article 1. An intermediate position of the first pivoting frame 106 is illustrated in FIG. 17.

As shown in FIG. 4, the first pivoting frame 106 has a "C" shaped frame on which are mounted the first clamping means, the front stapler 137 and the third moving means for moving the front stapler 137.

Figure 16:
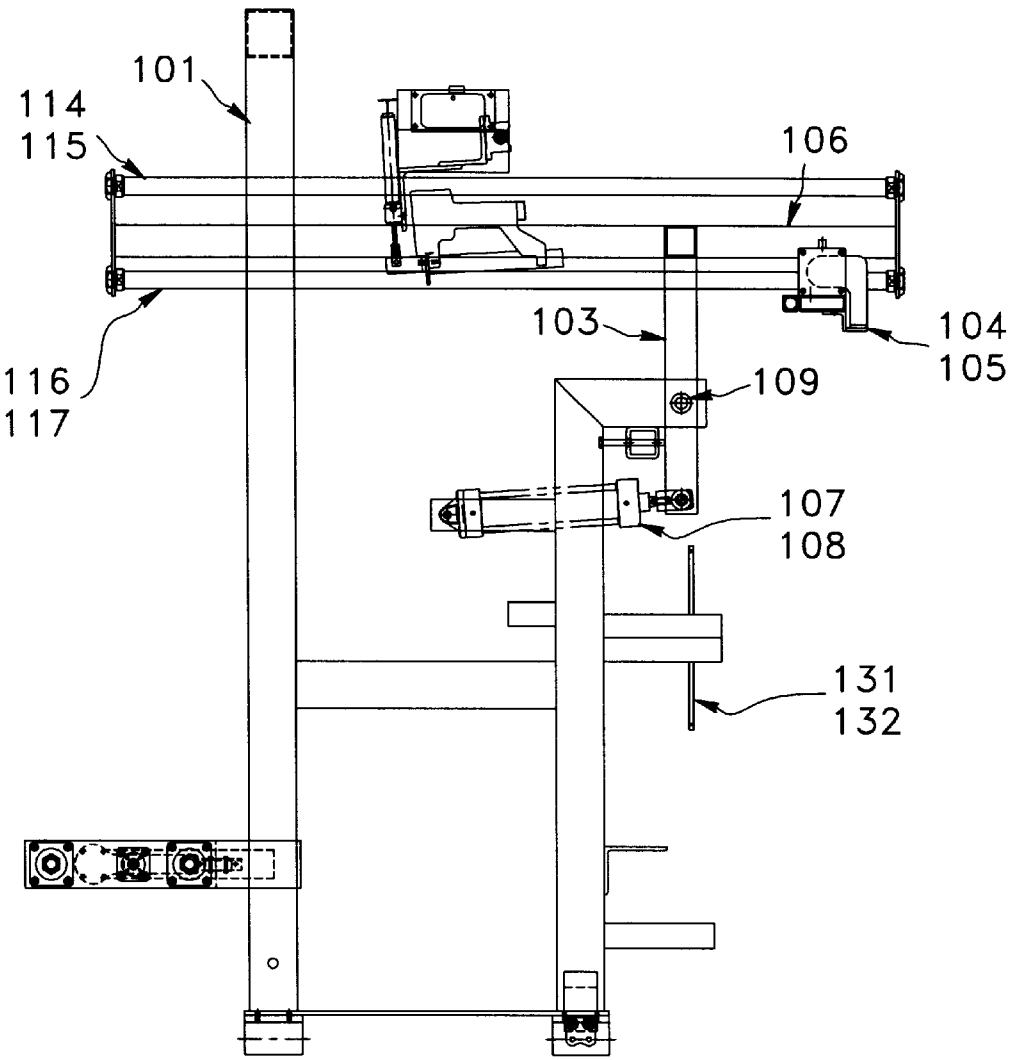
FIG. 16 is a side view of the first assembly of the machine shown in FIG. 1, where the first pivoting frame is in an horizontal position.
Figure 17:
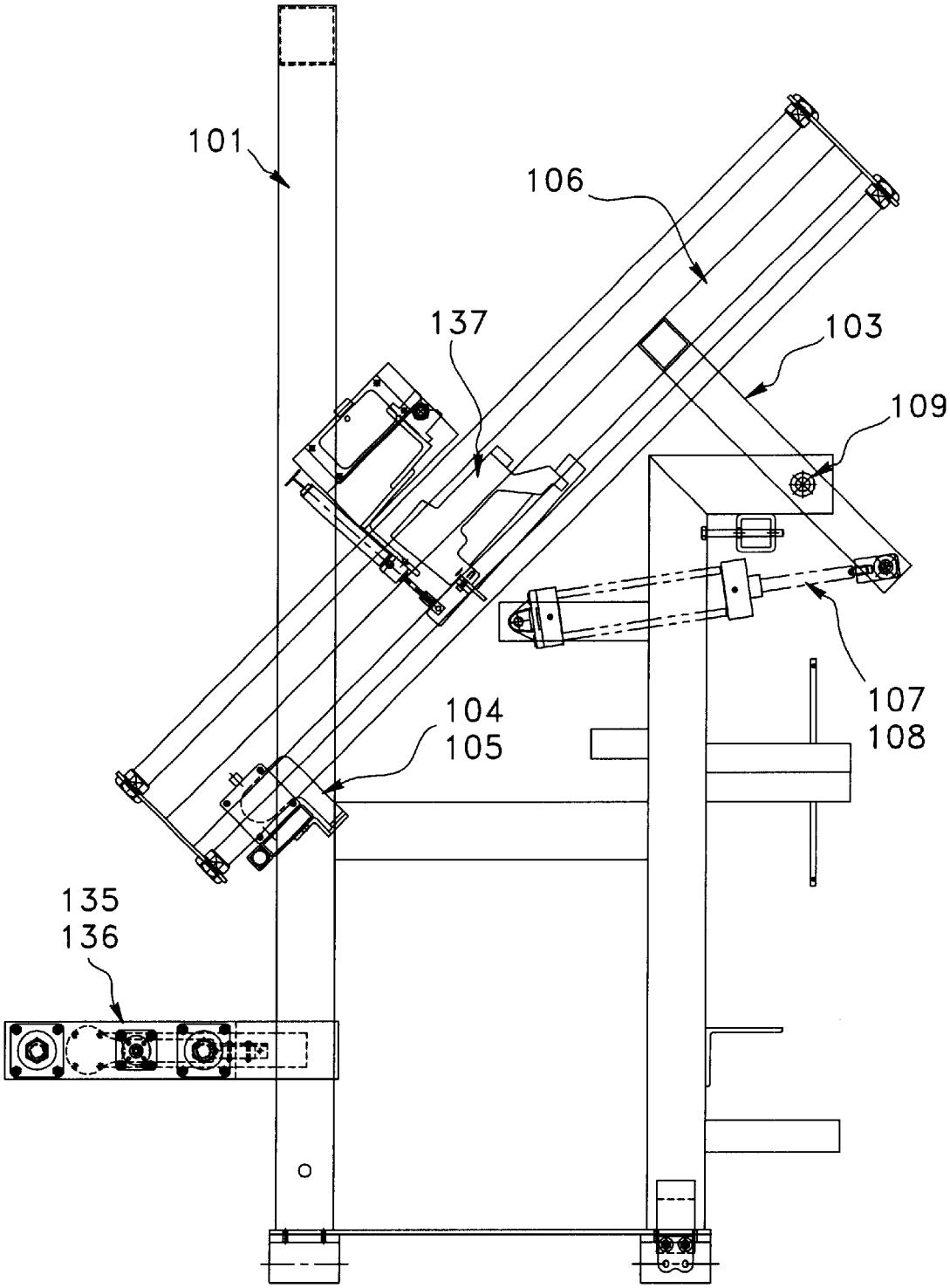
FIG. 17 is a side view of the first assembly shown in FIG. 16, except that the first pivoting frame is in a diagonal position.
Figure 18:
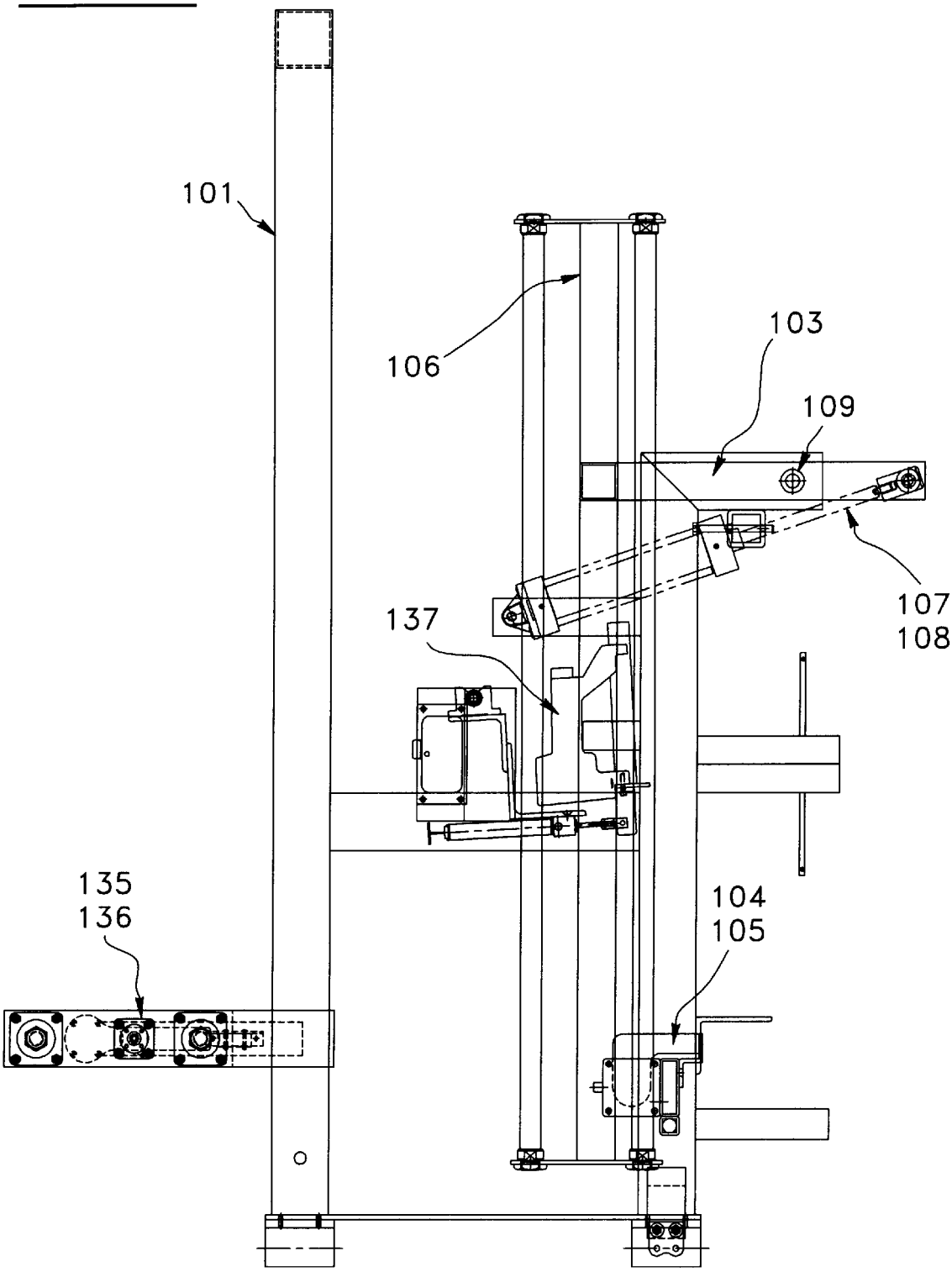
FIG. 18 is a side view of the first assembly shown in FIGS. 16 and 17, except that the first pivoting frame is in a vertical position.

The main frame 101 of the first assembly 100 has a substantially "H" shape as Illustrated in the side views of FIGS. 16 to 18. The main frame 101 constitute two "H" shaped frames interconnected by an upper part and a lower part thereof as shown in the front view of FIG. 3. the first pivoting frame 106 is pivotally mounted on each opposite "H" shaped frame of said main frame 101 by means of a bracket 103 which may rotate around the pivot 109. The rotation of the brackets 103 is driven by the first pivoting means which comprise two powered cylinders 107 and 108 on the opposite "H" shaped frames of the main frame 101 respectively.

Figure 5:
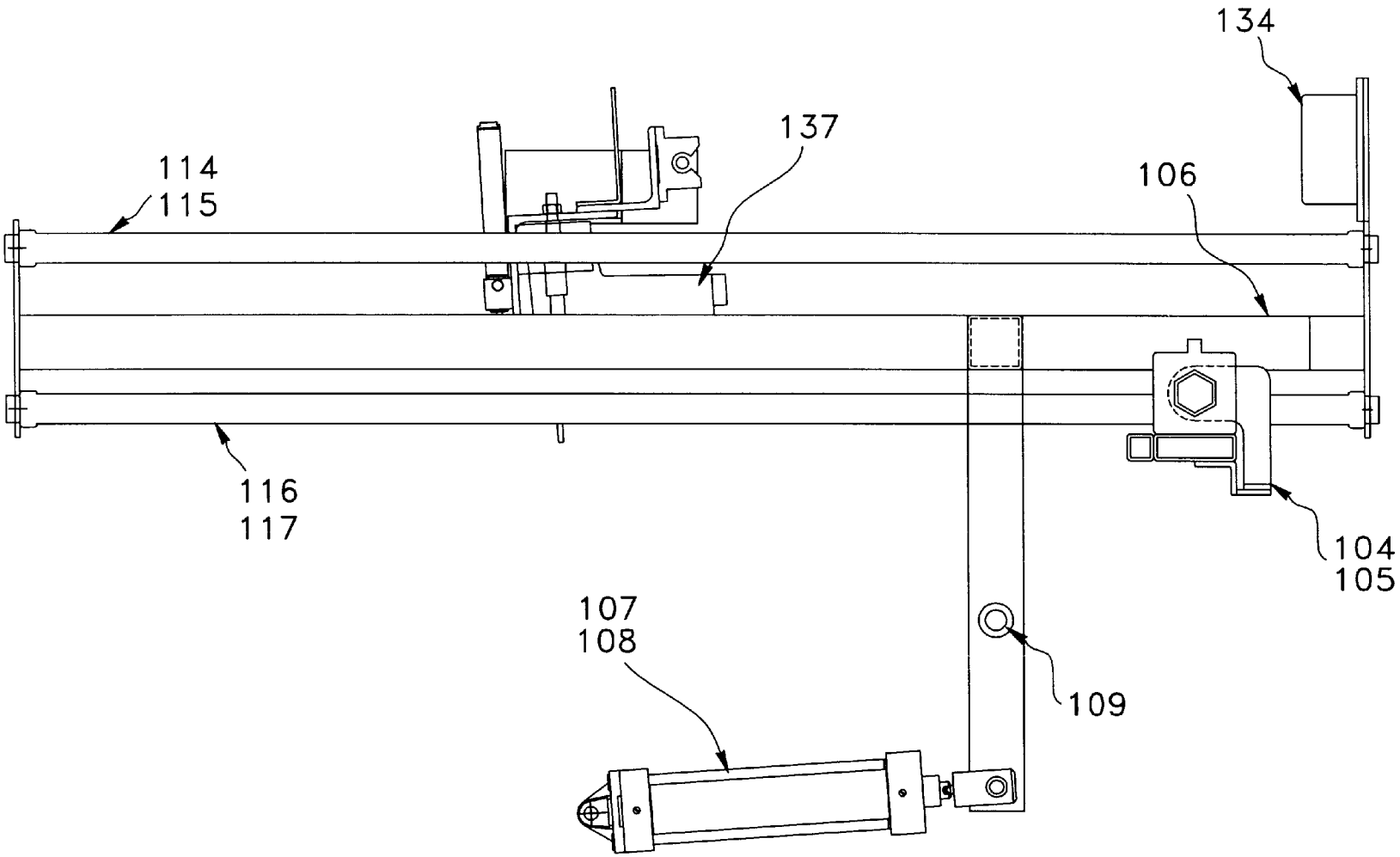
FIG. 5 is a side view of the first pivoting frame shown in FIG. 4.

Referring more particularly to FIGS. 5 and 16, the first moving means further comprise translating moving means for translating the clamps 104 and 106 of the first clamping means along the first pivoting frame 106. The translating means comprise a powered cylinder 116 or 117 for translating each clamp 104 or 105 respectively.

We will now describe different elements of the second assembly 200. Referring more particularly to FIGS. 1, 13, 14 and 16, the second moving means comprise preferably a second pivoting frame 206 pivotally mounted on the main frame 201 of the second assembly 200, and second pivoting means for pivoting the second pivoting frame 206 between an horizontal position (shown in FIG. 13) higher than the height of the back surface 21 of the article 1 and a vertical position (shown in FIG. 15) parallel to the back surface 21 of the article 1. An intermediate position of the second pivoting frame 206 is illustrated in FIG. 14.

As shown in FIG. 7, the second pivoting frame 206 has a "C" shaped frame on which are, mounted the second clamping means, the rear stapler 239 and the fourth moving means for moving the rear stapler 239.

Figure 13:
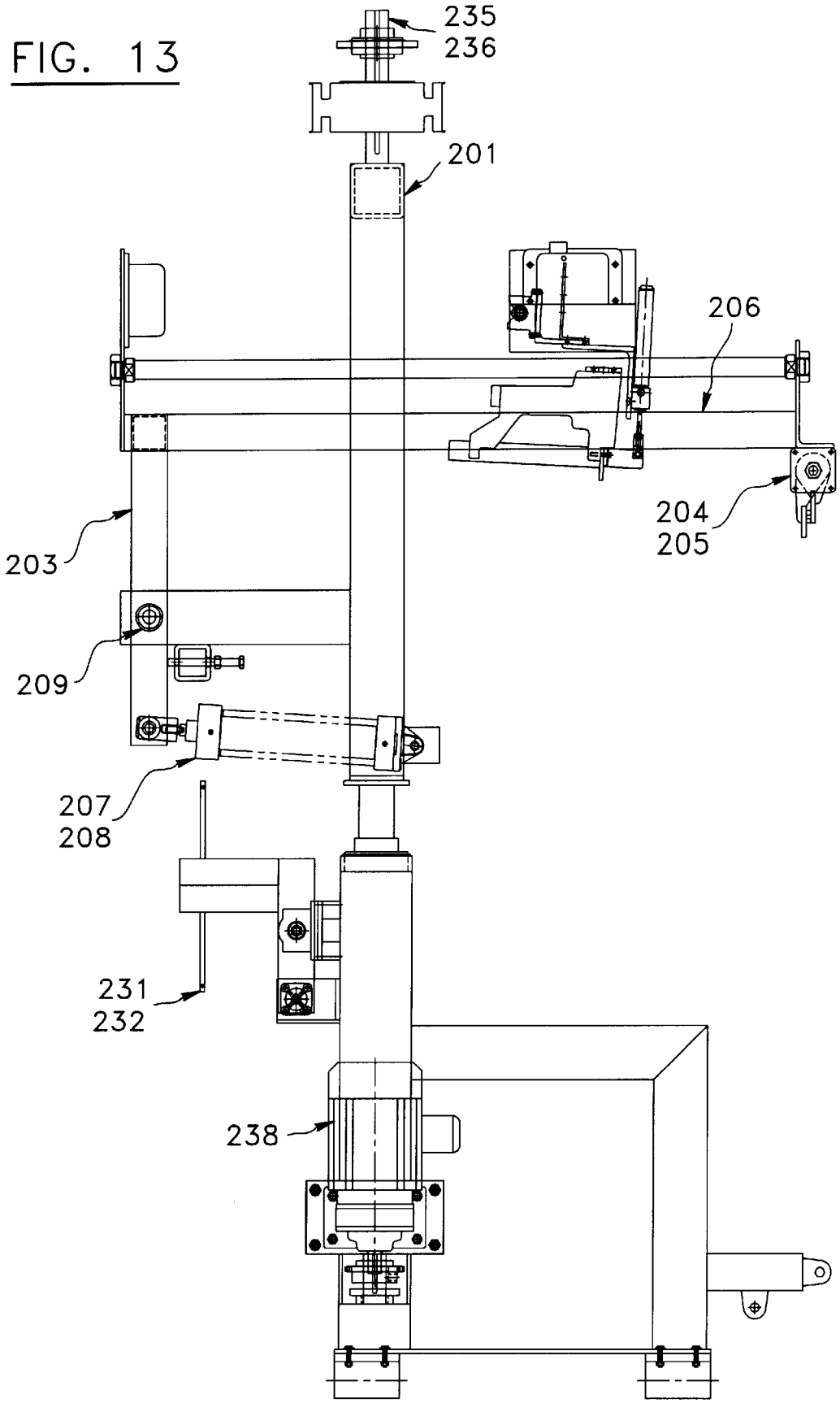
FIG. 13 is a side view of the second assembly of the machine shown in FIG. 1, where the second pivoting frame is in an horizontal position.
Figure 14:
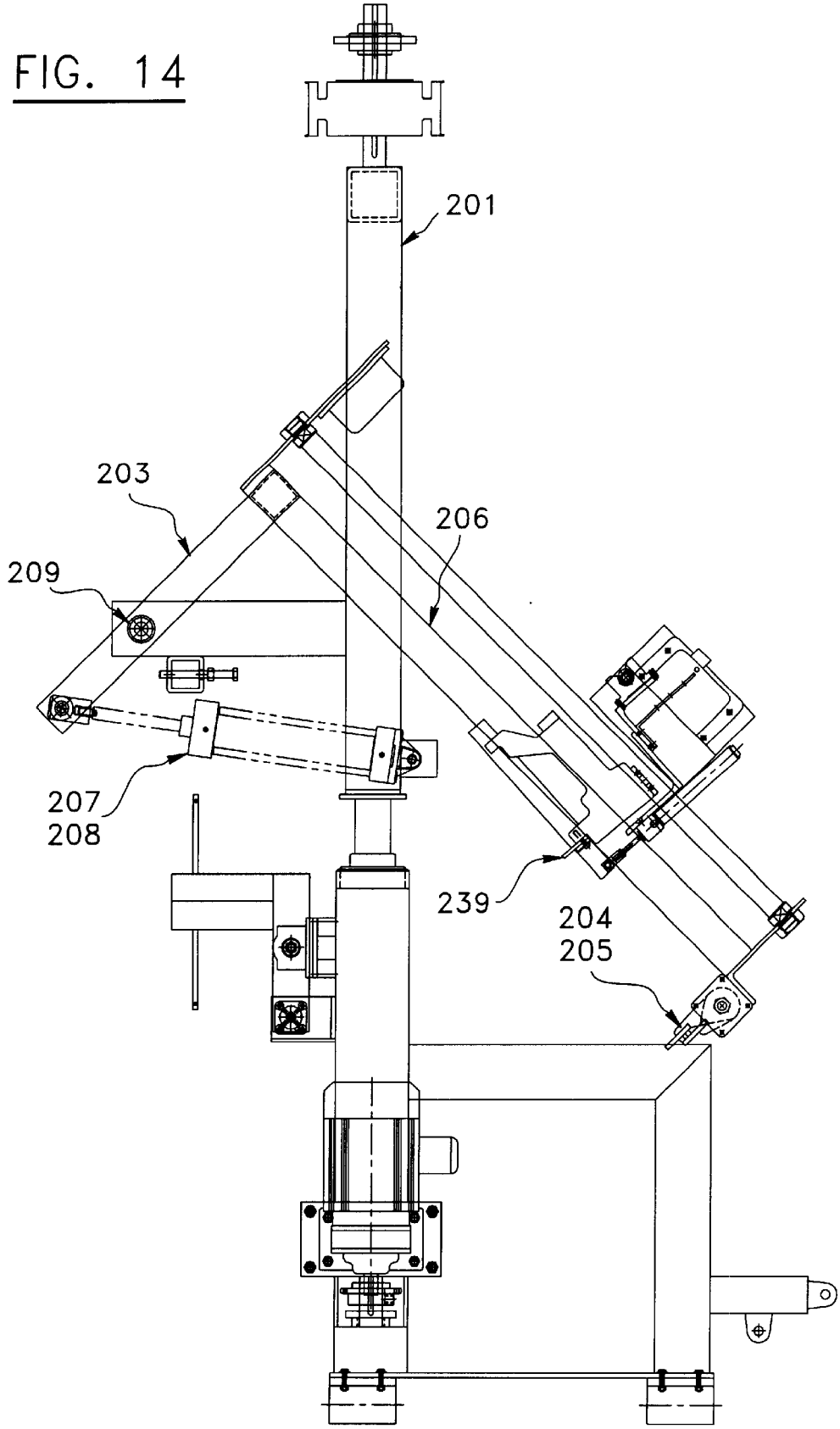
FIG. 14 is a side view of the second assembly shown in FIG. 13, except that the second pivoting frame is in a diagonal position.
Figure 15:
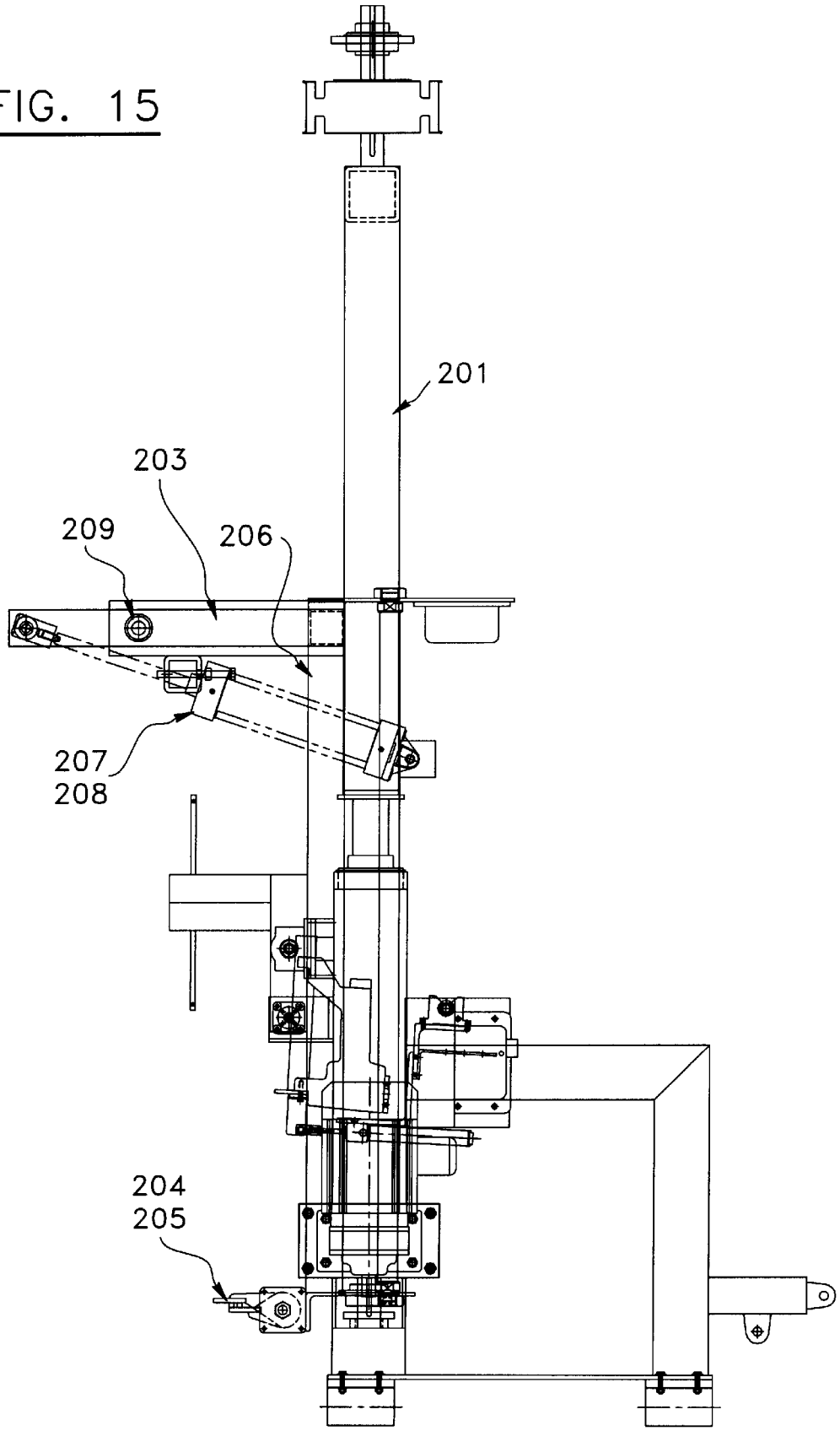
FIG. 15 is a side view of the second assembly shown in FIG. 13, except that the second pivoting frame is in a vertical position.

The main frame 201 of the second assembly 200 has a substantially "b" shape as Illustrated in the side views of FIGS. 13 to 15. The main frame 201 constitute two "b" shaped frames interconnected by an upper part and a lower part thereof as shown in the front view of FIG. 6. The second pivoting frame 206 is pivotally mounted on each opposite "b" shaped frame of said main frame 201 by means of a bracket 203 which may rotate around the pivot 209. The rotation of the brackets 203 is driven by the second pivoting means which comprise two powered cylinders 207 and 208 on the opposite "b" shaped frames of the main frame 201 respectively.

Figure 6:
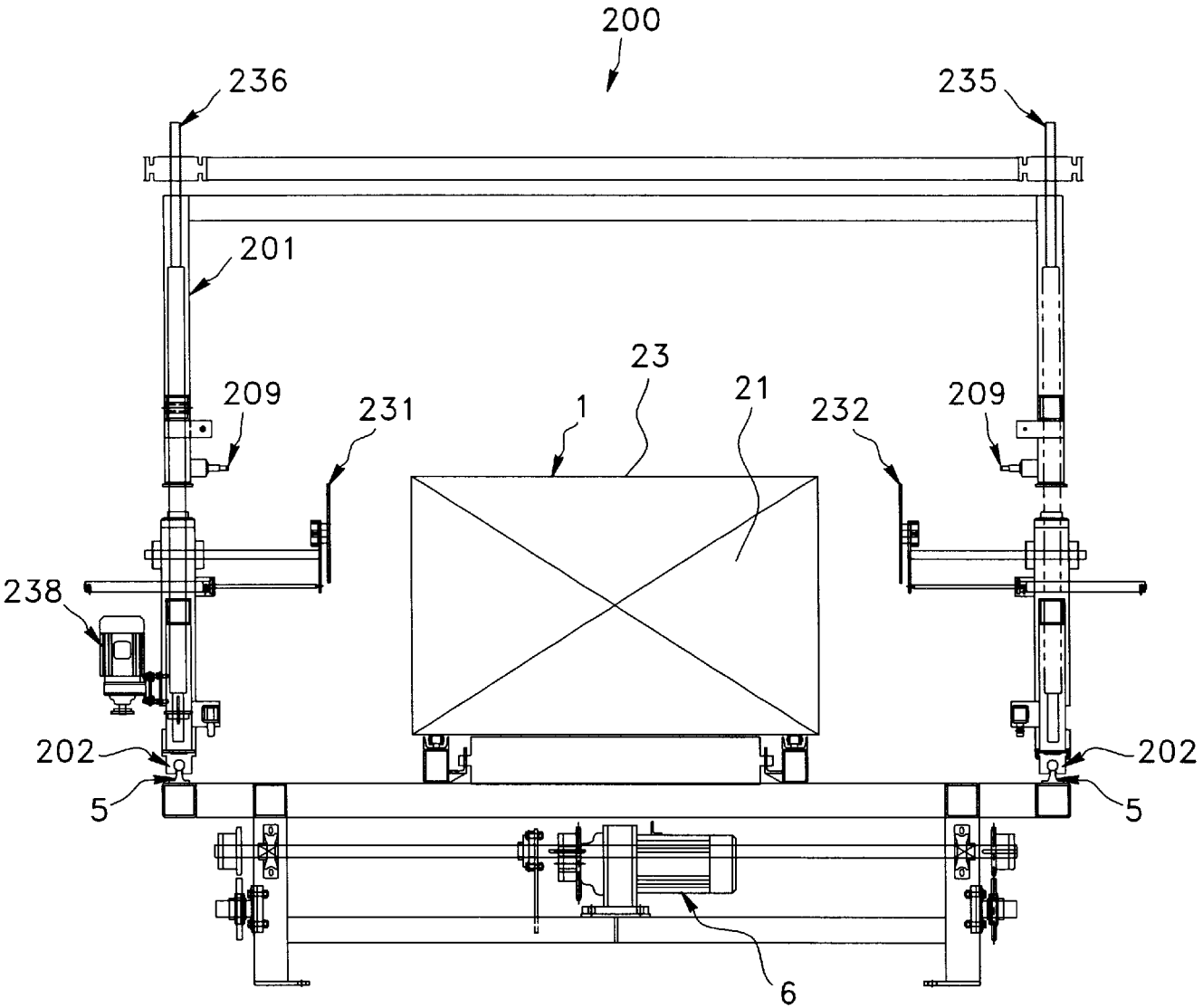
FIG. 6 is rear view of the second assembly of the machine shown in FIG. 2, where the second pivoting frame is missing for sake of clarity.

Referring more particularly to FIGS. 1, 6 and 13, the second moving means further comprise fifth moving means for moving the second pivoting frame 206 vertically with respect to the second assembly 200. The fifth moving means comprise vertical threaded shafts 235 and 236 passing through the opposite "b" shaped frames of the main frame 201 respectively. The fifth moving means further comprise a motor 238 for driving the threaded shafts 236 and indirectly the threaded shafts 235.

Referring now more particularly to FIGS. 6 and 13, it should be understood that the dimensions the machine 10, shown in FIG. 1, may vary in order to wrap different sizes of article 1. It is also contemplated That the machine 10 can adapt itself to a variable width and height of the article 1 to be wrapped could also be constructed. The pivots 109 and 209 could be mounted on linear jacks or the like such as electric motorized screws so that the pivots 109 and 209 can be aligned with the top surface 23 of the article 1 detected by an optical or proximity sensor. Should the variations of the dimensions of the article 1 be such that the width of the web 9 would need to be reduced to avoid the web 9 to exceed below the article 1, the machine 10 can comprise a pair of laterally adjustable rotary blades installed under the shelf 313 to cut the excess of web 9 symmetrically on side portions 30 of the web 9, shown in FIG. 28. With the machine 10 being so adapted, it can comply with a wide range of article sizes, since the width of the web 9 is selected with respect of the width of the article 1 to be wrapped.

We will now describe the blowers of the machine 10 according to the preferred embodiment of the invention. Referring to FIG. 28, the machine 10 comprises folding means for folding the web piece 12 around the article 1 so that the resulting wrapped article has a clean and neat appearance. The folding means hereinafter described are designed more particularly for wrapping a parallelepipedly shaped article 1.

Referring to FIGS. 3, 16, 17, 18, 28 and 29, the preferred folding means comprise two blowers 131 and 132 mounted respectively on the opposite "H" shaped frames of the main frame 101 of the first assembly 100 for blowing corners 18 of the first end 14 of the web piece 12 towards each other while the clamps 104 and 105 of the first clamping means having the first end 14 of the web piece 12 clamped therein move from an initial position to a final position located on a lower edge of the front surface 20 of the article 1. The final and fold position of the corners 18 is shown in FIG. 29 and the diagonal dotted lines illustrate folded lines 13 in the web piece 12. The movement of the clamps 104 and 105 between the initial position and the final position located on a lower edge of the front surface 20 is essentially driven by the powered cylinders 107 and 108 which pivot the first pivoting frame 108 around the pivot 109 and is illustrated the sequence of FIGS. 16, 17 and 18.

Referring to FIGS. 6, 13, 14, 15, 28 and 29, the preferred folding means further comprise two blowers 231 and 232 mounted respectively on the opposite "b" shaped frames of the main frame 201 of the second assembly 200 for blowing corners 19 of the second end 15 of the web piece 12 towards each other while the clamps 204 and 205 of the second clamping means having the second end 15 of the web piece 12 clamped therein move from an initial position to a final position located on a lower edge of the back surface 21 of the article 1. The movement of the clamps 204 and 205 between the initial position and the final position located on a lower edge of the back surface 21 is essentially driven by the powered cylinders 207 and 208 which pivot the second pivoting frame 206 around the pivot 209 and is illustrated the sequence of FIGS. 13, 14 and 15. Basically, the action of the blowers 131, 132, 231 and 232 is push the corners 18 and 19 under a central portion of the first and second ends 14 and 15 located between the clamps 104, 105 and the clamps 204, 205 respectively. The movement of the clamps 104, 105, 204 and 205 sandwiches the corners 18 and 19 under the central portions of the first and second end 14 and 15. After the web folding, the web piece 12 is fasten to the article 1 as above described.

Many types of folding means may be designed without departing from the scope of the invention to carry out the folding of the web piece 12 such as using retractable arms or the like for folding the corners 18 and 19 of the web piece 12 as described above.

Figure 20:
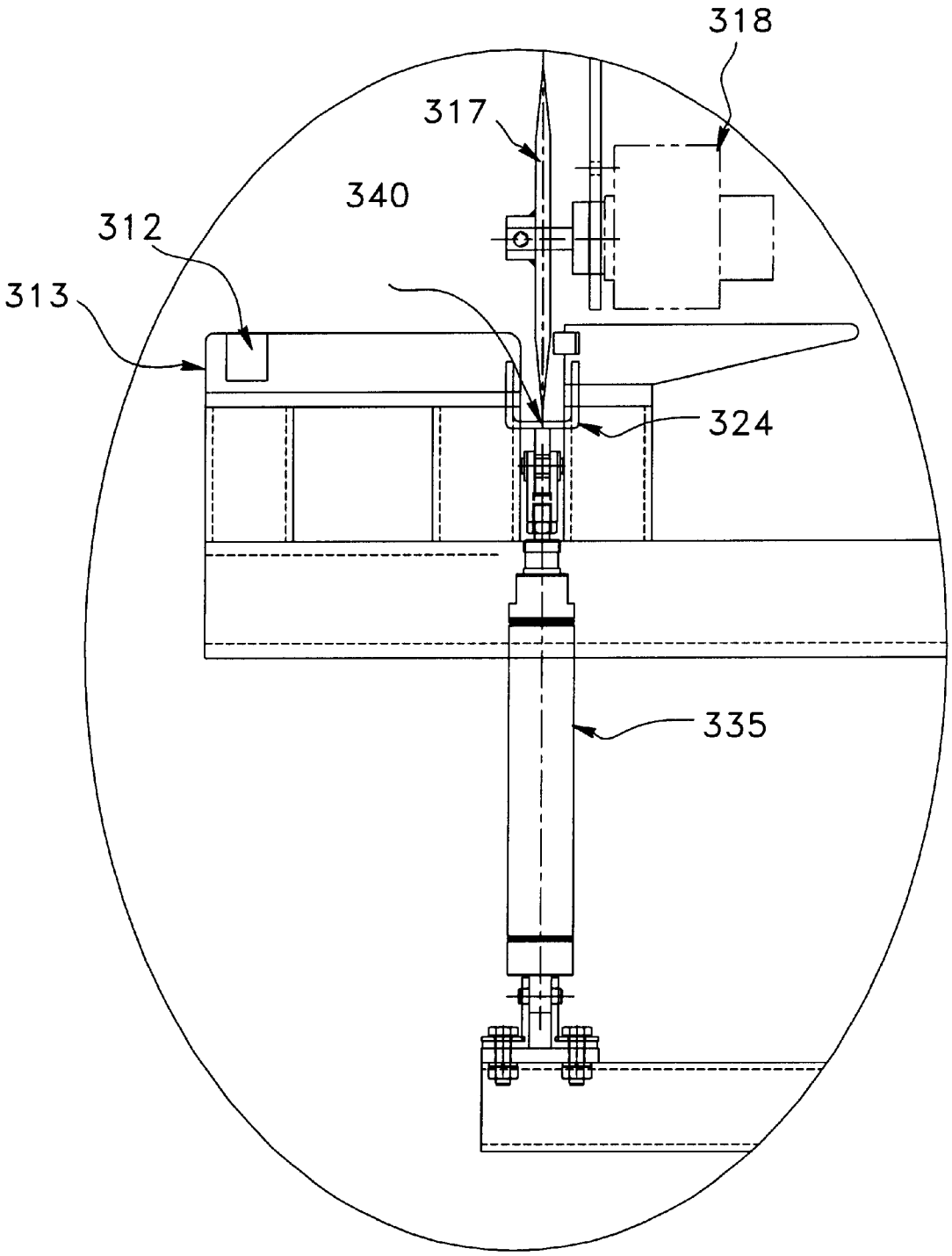
FIG. 20 is a side view of a portion of the third assembly shown in FIGS. 9 and 10, showing the retractable supporting means being in an horizontal position in relation with the cutting means.

We will now describe the anti-static electrode 312 of the machine 10, shown in FIG. 1, according to the preferred embodiment of the invention and we will refer more particularly to FIGS. 9, 12 and 20. Many kind of web 9 as the one shown in FIG. 27, may be used such as fabric, plastic film and the like. The choice of the type of web 9 depends on the type of article 1 to be wrapped and the necessity to be permeable, semipermeable or impermeable. Using certain kinds of web 9 with the wrapping machine 10 can results in creation of static electricity. Such static electricity in mainly generate by the web delivering means and can interfere with positioning and folding of the web piece 12 over the article 1. In order to overcome this inconvenient, the machine 10 further comprises an anti-static electrode 312 located at an exit point of the web 9 from the web delivering means. Thus, the contact of the web with the electrode 312 is done just before the web 9 leaves the web delivering means. More particularly, the electrode 312 is located at an external extremity of the shelf 313. Other devices can be used for overcome this inconvenience such as static eliminating brush and tinsel. A grounded tinsel wire in conductive copper strands has been used for such purpose.

Referring to FIG. 26, the controller 60 receives input signals from the detector 8 for detecting the front surface 20 of the article 1, the detector 143 for detecting the back surface 21 of the article 1, the detectors 133 and 134 for detecting the position of the front stapler 137, the detectors 233 and 234 detecting the position of the rear stapler 239

Still referring to FIG. 26, the controller 50 transmits output signals o the motor 7 of the conveyor 2, the motor 6 for sliding the first assembly 100, the cylinders 107 and 108 for pivoting the first pivoting frame 106, he cylinders 116 and 117 for the translation of the clamps 104 and 105, the rotary cylinders 146 of the clamps 104 and 105, the first cylinder 118 for moving horizontally the front stapler 137, the second cylinders 114 and 115 for moving vertically the front stapler 137, the front stapler 137, the side stapler 135 and 136, the cylinder 326 for sliding the second assembly 200, the cylinders 207 and 208 for pivoting second pivoting frame 206, the rotary cylinders 227 and 228 of the clamps 204 and 205, the first cylinder 219 for moving horizontally the rear stapler 239 the rear stapler 239, the second cylinders 221 and 222 for moving vertically the front stapler 239, the blowers 131, 132, 231 and 232, the motorized upper drive roller 309, the cylinder 334 and 335 for pivoting the retractable support 324 and 325, the circular rotary blade 317 and the cylinder 319 for sliding the blade 317.

The present invention also provides a method for wrapping an article 1 which will be now described with references to FIGS. 9, 27, 28 and 29. The method of the invention is preferably perform with the machine 10 above-described. The machine 10 necessitates an initial preparation for being ready to perform the method for wrapping. Referring to FIG. 9, the initial preparation includes installing a roll 305 of web 9 of the cradle rollers 306 and 307, slipping the web 9 from the roll 305 between the cradle rollers 306 and 307, in front of a guiding roll 330, behind the tension relief roller 308, between the lower roller 310 and the motorized upper drive roller 309, and around the shelf 313 where the fold side portions 30 of the web 9 is slid under the shelf 313 and the central portion 31 thereof is slid over the shelf 313.

Still referring to FIG. 9, the method is fully automated and comprises the step (a) of delivering a web 9 by means of a web delivering means. The action of the motorized upper drive roller 309 pushes the web until it extends out the shelf 313.

Referring to FIG. 17, the method further comprises the step (b) of clamping a first end 14 of the web 9 extending from the shelf 313 by means of the clamps 104 and 105, and the following step (c) of moving away from the shelf 313, the clamps 104 and 105 having the first end 14 clamped therein. According to a preferred embodiment of the invention, in the step (c), the first end 14 is moved away from the shelf 313 at a specific distance which is in relation with the length of the article 1 so that the rotary blade 317 is in a proper position to cut a web piece 12 having a size adapted to cover a top surface 73, a front surface 20, a back surface 21 and two opposite side surfaces 22 of the article 1. For practical purpose, the second pivoting frame 206 is raised up by means of the motor 238 and the threaded shafts 235 and 236, shown in FIGS. 13 and 27, in order to clear a sufficient space for allowing the first assembly 100 to slide under it and the clamps 204 and 205 to reach the web 9 extending out the shelf 313 and perform step (b).

Referring to FIGS. 9 and 20, the method further comprises the step (d), executed after step (c), of cutting the web 9 extending from the lower roller 310 and the motorized upper drive roller 309 and therefor providing a web piece 12, shown in FIG. 28, for wrapping the article 1. Advantageously, the clamps 204 and 205 are also used to stabilized the web 9 during the cutting step (d). To do so, the method further comprises, before step (d), the step (x) of moving the clamps 204 and 205 in proximity of the rotary blade 317; and the step (y) of squeezing the second end 15 of the web piece 12 between the longer jaws 224 (shown in FIGS. 24 and 25) of the clamps 204 and 205 and the shelf 313 by engaging the two cavities 321 and 322 (shown in FIG. 11) provided in the shelf 313. Therefor, the step (d) further comprises the step (z) of maintaining the squeezing action of step (y) for stabilizing the web 9 during the cutting action. It should be understood that the step (x) of moving the clamps 204 and 205 in proximity of the rotary blade 317 comprises the step of lowering the second pivoting frame 206 since it has been raised tip for allowing step (b).

Referring to FIG. 27, the method further comprises the step (e) which follows step (d), of clamping a second end 15 of the web piece 12 that is a free end opposite to said first end 14 and that has been generated by the cutting step (d) with the clamps 204 and 205. In the case that the step (z) is performed, the shorter laws 225 stayed in the open position are ready to pivot towards the respective longer jaws 224 and therefor clamp the second end 15 in order to perform step (e).

Referring to FIGS. 13 to 18, 27 and 28, the method further comprises the step (f), which follows step (e), of moving and putting down the web piece 12 over the article 1 by moving the clamps 104 and 105 and moving the clamp, 204 and 205. According to a preferred embodiment of the invention, the Step (f) comprises the sub-step (f-1) of pivoting the clamps 104 and 105 to bring the first end 14 of the web piece 12 at a lower edge of the front surface 20 of the article 1, and the sub-step (f-2), which is performed during step (f-1), of blowing corners 18 of the first end 14 of the web piece 12 towards each other while the clamps 104 and 105 having the first end 14 of the web piece 12 clamped therein move from an initial position to a final position located on a lower edge of the front surface of the article 1. In sub-step (f-1), it should be understood that the action of pivoting the clamps 104 and 105 is executed by pivoting the first pivoting frame 106 by means of the powered cylinders 107 and 108. The step (f) further comprises the sub-step (f-3) of pivoting the clamps 204 and 205 to bring the second end 15 of the web piece 12 at a lower edge of the back surface 21 of the article 1; and (f-4), which is performed during step (f-3), of blowing corners 19 of the second end 15 of the web piece 12 towards each other while the clamps 204 and 205 having the second end 15 of the web piece 12 clamped therein move from an initial position to a final position located on a lower edge of the back surface 21 of the article 1. In sub step (f-3), it should be understood that the action of pivoting the clamps 204 and 205 is executed by pivoting the second pivoting frame 206 by means of the powered cylinders 207 and 208. For practical purpose, the sub-step (f-3) comprise a prior step of moving the second assembly 200 away from the third assembly 300 by means of the powered cylinder 326 in order that the shelf 313 would not interfere with the second pivoting frame 206 when it pivots. Advantageously, the sub-steps (f-1) and (f-3) are executed simultaneously in order to reduce time consuming.

Referring to FIGS. 3, 14, 17 and 28, the method further comprises the step (g), executed after step (f), of fastening the web piece 12 on the article 1. Still according to the preferred embodiment, the step (g) comprises the sub-step (g-1) of fastening the web piece 12 to the front surface 20 and back surface 21 of the article 1 by means of the front stapler 137 and the rear stapler 239; the sub-step (g-2) of conveying the article 1 away from the wrapping area 17; and the sub-step (g-3), executed during sub-step (g-2). of fastening the web piece to the two opposite sides of the article by means of the two side staplers 135 and 136. An other way to fasten the web piece 12 to the side surfaces 22 of the article 1 could be to slide the first assembly 100 towards the back surface 21 of the article 1. As above mentioned, it is not necessary to move The article 1 for wrapping it. However it is less time consuming the fasten side surfaces 22 thereof while conveyed out the wrapping area 17.

It should be understood that in steps of the above described method may be executed in a different sequence and some of them may be executed simultaneously.

While embodiments of this invention have been illustrated in the accompanying drawings and described above, it will be evident to those skilled in the art that changes and modifications may be made therein without departing from the essence of this invention. All such modifications or variations are believed to be within the scope of the invention as defined by the claims appended hereto.

What is claimed is:

1. A wrapping machine for wrapping an article located in a wrapping area, comprising:

web delivering means for delivering a web;

first clamping means for clamping a first end of the web extending from the web delivering means;

first moving means for moving the first clamping means;

cutting means for cutting the web extending from the web delivering means and therefor providing a web piece for wrapping the article;

second clamping means for clamping a second end of the web piece that is a free end opposite to said first end;

second moving means for moving the second clamping means;

fastening means for fastening the web piece on the article; and a controller for controlling the web delivering means, the first and second clamping means, the first and second moving means, the cutting means, and the fastening means following a predetermined sequencing program in such a way that, in operation, the web piece is moved and put down over the article by means of the first and second clamping means and the first and second moving means, and is fastened to the article by means of the fastening means, wherein:

(i) the first moving means comprise:

a first assembly on which the first clamping means is mounted; and a first sliding means for sliding the first assembly along the wrapping area, the first sliding means being controlled by the controller; and (ii) the second moving means comprise:

a second assembly on which the second clamping means is mounted; and a second sliding means for sliding the second assembly, the second sliding means being controlled by the controller;

the machine further comprising:

a third assembly on which the web delivering means and the cutting means are mounted.

2. The machine of claim 1, wherein the fastening means comprise:

a front stapler mounted on the first assembly for stapling the web piece to a front surface of the article;

a third moving means for moving the front stapler along the front surface of the article, the third moving means being mounted on the first assembly;

a rear stapler mounted on the second assembly for stapling the web piece to a back surface of the article; and a fourth moving means for moving the rear stapler along the back surface of the article, the fourth moving means being mounted on the second assembly.

3. The machine of claim 2, wherein each of the third and fourth moving means comprise:

a first powered cylinder;

a second powered cylinder, the second powered cylinder being perpendicular to the first powered cylinder; and detecting means for detecting a position of the corresponding stapler along each of said cylinders and providing an output signal to the controller.

4. The machine of claim 2, wherein the fastening means further comprise two side staplers mounted respectively on opposite sides of the first assembly for fastening side portions of the web piece to side surfaces of the article.

5. The machine of claim 1, further comprising:

a conveyor controlled by the controller for conveying the article within the wrapping area;

first detecting means for detecting a back surface of the article and providing an output signal to the controller which, in operation, controls the conveyor to align the back surface of the article with a proper location in the wrapping area; and second detecting means for detecting a front surface of the article and providing an output signal to the controller which, in operation, controls the first moving means to move the first clamping means away from the web delivering means at a specific distance which is in relation with the length of the article so that the cutting means is in a proper position to cut a web piece having a size adapted to cover a top surface, a front surface, a back surface and two opposite side surfaces of the article.

6. The machine of claim 5, wherein the web delivering means has a roll support supporting a roll of web from which the web is delivered, the web in the roll has two opposite side portions that fold under a central portion thereof, the central portion having a width which is slightly superior to the width of the top surface of the article.

7. The machine of claim 1, further comprising:

a conveyor controlled by the controller for conveying the article within a wrapping area;

first detecting means mounted on the second assembly for detecting a back surface of the article and providing an output signal to the controller which, in operation, controls the conveyor to align the back of the article with a proper location in the wrapping area; and second detecting means mounted on the first assembly for detecting a front surface of the article and providing an output signal to the controller which, in operation, controls the first moving means to move the first clamping means away from the web delivering means at a specific distance which is in relation with the length of the article so that the cutting means is in a proper position to cut a web piece having a size, adapted to cover a top surface, a front surface, a back surface and two opposite side surfaces of the article.

8. The machine of claim 7, wherein:

the first clamping means comprise a pair of clamps for clamping two points on the first end of the web that are spaced apart by a distance corresponding to a width of the top surface of the article and centrally located along the first end of the web; and the second clamping means comprise a pair of clamps for clamping two points on the second end of the web piece that are spaced apart by a distance corresponding to the width of the top surface of the article and centrally located along the second end.

9. The machine of claim 8, wherein the first moving means comprise:

a first pivoting frame pivotally mounted on the first assembly;

first pivoting means for pivoting the first pivoting frame between an horizontal position higher than the height of the front surface of the article and a vertical position parallel to the front surface of the article; and translating moving means for translating the first clamping means along the first pivoting frame;

and wherein the second moving means comprise:

a second pivoting frame pivotally mounted of the second assembly;

second pivoting means for pivoting the second pivoting frame between an horizontal position higher than the height of the back surface of the article and a vertical position parallel to the back surface of the article;

fifth moving means for moving the second pivoting frame vertically with respect to the second assembly; and third pivoting means for pivoting the second clamping means around an horizontal axis parallel to the back surface of the article.

10. The machine of claim 9, further comprises folding means including:

two blowers mounted respectively on opposite sides of the first assembly for blowing corners of the first end of the web piece towards each other while the first clamping means having the first end of the web piece clamped therein move from an initial position to a final position located on a lower edge of the front surface of the article; and two blowers mounted respectively on opposite sides of the second assembly for blowing corners of the second end of the web piece towards each other while the second clamping means having the second end of the web piece clamped therein move from an initial position to a final position located on a lower edge of the back surface of the article.

11. The machine of claim 1, wherein the first sliding means and the second sliding means comprise respectively:

a pair of rails parallel to opposite sides of the wrapping area; and sliding members mounted respectively under the first and second assemblies for slidably engaging the rails.

12. The machine of claim 1, wherein the web delivering means comprise an anti-static electrode located at an exit point of the web from the web delivering means.

* * * * *

UNITED STATES PATENT AND TRADEMARK OFFICE

CERTIFICATE OF CORRECTION

PATENT NO. : 6,460,314 B1
DATED : October 8, 2002
INVENTOR(S) : A. Girard et al.

It is certified that error appears in the above-identified patent and that said Letters Patent is hereby corrected as shown below:

Column 1,
Line 63, "," after "drawbacks" should be -- . --

Column 2,
Line 1, "tho" should be -- the --
Line 52, "stop" should be -- step --

Column 3,
Line 2, "at" should be -- of --
Line 65, "Figs. 9 and 10" should be -- Fig. 10 --

Column 4,
Line 43, before "piece" -- web -- should be inserted
Line 53, "throe" should be -- three -- and "tho" should be -- the --

Column 6,
Line 25, "It" should be -- it --
Line 63, "throe" should be -- three -- and "tho" should be -- the --

Column 7,
Line 1, "306" should be -- 305 --
Line 8, "30b" should be -- 305 --
Line 9, "309" should be -- 305 --
Line 11, "told" should be -- fold --
Line 64, "law" should be -- jaw --

Column 8,
Line 18, "the" should be -- The --
Line 28, "106" should be -- 105 --

Column 9,
Line 43, "108" should be -- 106 --

Column 10,
Line 33, after "239" -- . -- should be inserted
Line 35, "o" should be -- to --
Line 37, "he" should be -- the --
Line 47, after "239" -- , -- should be inserted

UNITED STATES PATENT AND TRADEMARK OFFICE

CERTIFICATE OF CORRECTION

PATENT NO. : 6,460,314 B1
DATED : October 8, 2002
INVENTOR(S) : A. Girard et al.

It is certified that error appears in the above-identified patent and that said Letters Patent is hereby corrected as shown below:

Column 11,
Line 2, after "web" -- 9 -- should be inserted
Line 14, "73" should be -- 23 --
Line 41, "tip" should be -- up --
Line 47, "laws" should be -- jaws --
Line 54, "clamp" should be -- clamps --

Column 12,
Line 28, after "(g-2)" "." should be -- , --
Line 37, "in" should be -- the --

Signed and Sealed this

Twenty-third Day of September, 2003

JAMES E. ROGAN
*Director of the United States Patent and Trademark Office*